US008636562B2

(12) United States Patent
Marton

(10) Patent No.: US 8,636,562 B2
(45) Date of Patent: Jan. 28, 2014

(54) SURFACE TREATING APPARATUS AND METHOD

(76) Inventor: Miksa Marton, Windsor (CA)

( * ) Notice: Subject to any disclaimer, the term of this patent is extended or adjusted under 35 U.S.C. 154(b) by 0 days.

(21) Appl. No.: 13/395,353

(22) PCT Filed: Aug. 9, 2011

(86) PCT No.: PCT/CA2011/000910

§ 371 (c)(1),
(2), (4) Date: Apr. 13, 2012

(87) PCT Pub. No.: WO2012/019286

PCT Pub. Date: Feb. 16, 2012

(65) Prior Publication Data

US 2012/0276824 A1 Nov. 1, 2012

(30) Foreign Application Priority Data

Aug. 10, 2010 (WO) ..... PCT/IB2010/001988

(51) Int. Cl.
*B24B 55/06* (2006.01)

(52) U.S. Cl.
USPC ..... 451/456; 451/359

(58) Field of Classification Search
USPC ..... 451/350–359, 451–460
See application file for complete search history.

(56) References Cited

U.S. PATENT DOCUMENTS 802,136 A 10/1905 Bushfield
1,800,341 A 4/1931 Davies
2,242,877 A 5/1941 Albertson
2,286,208 A 6/1942 Kirchner
2,478,074 A 8/1949 Atkin
2,815,618 A 12/1957 Buliga
3,239,971 A 3/1966 Freerks et al.
3,785,092 A * 1/1974 Hutchins ..... 451/357
3,932,966 A * 1/1976 Stern ..... 451/488

(Continued)

FOREIGN PATENT DOCUMENTS

DE 4223670 A1 6/1993
EP 141139 A2 5/1985

(Continued)

OTHER PUBLICATIONS

International Search Report in relation to PCT/CA2011/000910 dated Nov. 25, 2011.

(Continued)

*Primary Examiner* — Dung Van Nguyen
(74) *Attorney, Agent, or Firm* — Bereskin & Parr LLP/ S.E.N.C.R.L., s.r.l.

(57) ABSTRACT

A back-up apparatus for use with a surface treating apparatus can include a back-up plate having a pad attachment face and a back-up pad having a first pad face and a second pad face. The back-up apparatus can also include a porous interface layer. The interface layer can include an outer face. The back-up apparatus can also include a layer of a first adhesive on the outer face and extending into the interface layer, and a layer of a second adhesive provided on the layer of the first adhesive. The second adhesive can be selected to releasably adhesively bond to an abrasive sheet. The first and second adhesives can be selected such that the adhesive bond between the first adhesive and the second adhesive is stronger than the adhesive bond between the second adhesive and the abrasive sheet.

17 Claims, 15 Drawing Sheets

(56) References Cited

U.S. PATENT DOCUMENTS

| | | | | |
|---|---|---|---|---|
| 4,287,685 | A | 9/1981 | Marton | |
| 4,531,329 | A * | 7/1985 | Huber | 451/456 |
| 4,558,542 | A | 12/1985 | Marton | |
| 4,844,967 | A | 7/1989 | Goralski et al. | |
| 5,027,470 | A * | 7/1991 | Takashima | 15/385 |
| 5,810,650 | A * | 9/1998 | Jost | 451/527 |
| 5,919,085 | A * | 7/1999 | Izumisawa | 451/357 |
| 5,993,305 | A * | 11/1999 | Chu | 451/357 |
| 6,059,644 | A | 5/2000 | Manor et al. | |
| 6,413,157 | B1 | 7/2002 | Marton | |
| 6,758,732 | B1 * | 7/2004 | Hilton | 451/360 |
| 7,094,138 | B2 * | 8/2006 | Chang | 451/359 |
| 7,144,313 | B1 | 12/2006 | Greenwood | |
| 7,223,161 | B2 * | 5/2007 | Kodani et al. | 451/354 |
| 2007/0243803 | A1 | 10/2007 | Oka et al. | |
| 2009/0233527 | A1 | 9/2009 | Chung-Fat et al. | |

FOREIGN PATENT DOCUMENTS

| | | | |
|---|---|---|---|
| EP | 557773 | A1 | 9/1993 |
| WO | 99/24222 | A1 | 5/1999 |
| WO | 2005092572 | A1 | 10/2005 |

OTHER PUBLICATIONS

International Search Report in relation to PCT/IB2010/001988 dated May 6, 2011.

International Search Report in relation to PCT/CA2011/000910 dated Feb. 21, 2013.

* cited by examiner

SURFACE TREATING APPARATUS AND METHOD

FIELD

The present subject matter relates generally to apparatus for treating a surface, for example by sanding, grinding, polishing and the like and methods for treating a surface by, for example, sanding, grinding, polishing, buffing and the like.

BACKGROUND

PCT publication WO99/24222 (Luedeke) discloses a backup pad for engaging and supporting abrasive sheets, the backup pad is mounted securely to a drive shaft to prevent relative rotation thereto, and to allow easy mounting and dismounting of the backup pad to the mounting shaft without the use of tools. The backup pad includes a body comprising a front surface and a back surface, releasable engagement means provided on the front surface for releasably engaging an abrasive article, and a mounting boss provided on the rear surface. The mounting boss includes a first end facing away from the body, and an opening in the first end of the boss, the opening being formed by an inner surface generally perpendicular to the body and defining a non-circular cross section. The opening includes elastic means such as an o-ring for releasably engaging a drive shaft mounted in said opening.

U.S. Pat. No. 4,558,542 (Marton) discloses an abrasive or sanding disc for use on a rotary or double action backup pad. The abrasive disc includes on its rear surface a smooth flexible coating to give strength to the sandpaper and to stick to a feathering adhesive on a backup pad. The smooth coating is typically a nylon coating or an adhesive which bonds to the back of the sandpaper and acts as a coating. The coating also adheres strongly to a feathering adhesive on a backup pad. The sanding disc can be strongly secured to the backup pad but can be pulled away from it, leaving the feathering adhesive on the backup pad.

U.S. Pat. No. 2,286,208 (Kirchner) discloses providing a layer of pressure sensitive adhesive on either the back of an abrasive coated sheet or on a permanent backing, by means of which the abrasive coated sheet can be quickly and easily attached to the permanent backing and held in firm attachment thereto during working operation, but which may be readily detached therefrom when the abrasive coated sheet becomes unduly worn or unfit for further service.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

A surface treating apparatus can include a driving apparatus and a back-up apparatus. The back-up apparatus can include a rear face (facing the driving apparatus) and an opposed abrasive mounting face. A suitable abrasive sheet can be releasably attachable to the abrasive mounting face. The releasable engagement between the abrasive sheet and the abrasive mounting face may help facilitate the replacement of a used or worn abrasive sheet with a new, replacement abrasive sheet or an abrasive sheet with a different grit. The driving apparatus can be any suitable type of driving apparatus that is compatible with the back-up apparatus, including, for example a rotary driving apparatus (including, for example electric and air-powered rotary drivers and grinders), and a double action driving apparatus.

In accordance with one aspect of the invention, the abrasive sheet can be attached to the abrasive mounting face using a releasable, reusable adhesive. Providing a releasable, reusable adhesive may help facilitate replacement of worn abrasive sheets. In accordance with this aspect the back-up apparatus can include a back-up plate, a back-up pad and an adhesive interface layer provided on the back-up pad. The back-up pad can provide mounting support for the abrasive sheet and, preferably, provides a cushioned backing. During use, an abrasive sheet is subjected to substantial forces in the plane of the abrasive sheet. If the adhesive used to secure the abrasive sheet in place is too weak, then the sheet may become dislodged during use and this may mar or otherwise spoil the surface being treated. If the adhesive is too strong, it may be difficult to remove worn abrasive sheets from the back-up pad, and/or portions of the abrasive sheet may tear and remain fixed to the back-up pad. An advantage of the interface layer is that it may provide a stronger, releasable attachment of the abrasive sheet to the back-up pad.

The abrasive sheet can include a back face that is compatible with the adhesive on the interface layer. Preferably, the back face is provided by a film layer that is bonded to the abrasive sheet. The film layer can be stronger than the abrasive sheet, and can help strengthen the abrasive sheet during use, and help reduce tearing or ripping of the abrasive sheet when it is peeled off of the adhesive interface layer. This may help prevent small pieces of the abrasive sheet from remaining deposited on the back-up apparatus, which may interfere with placement of the replacement abrasive sheet.

Preferably, the interface layer includes a plurality of upstanding fibres that are coated with a base adhesive. The base adhesive can then be covered with a second, tacky adhesive, that can be releasably bonded to the abrasive sheet. The adhesives can be selected so that the bond between the base and tacky adhesives is stronger than the bond between the tacky adhesive and the abrasive sheet. This may allow the abrasive sheet to be separated from the interface layer, without transferring the tacky adhesive from the interface layer to the abrasive sheet.

In accordance with this aspect, a back-up apparatus for use with a surface treating apparatus can include a back-up plate having a pad attachment face, a back-up pad having a first pad face, secured to the pad attachment face, and an opposed second pad face. The back-up apparatus can also include a porous interface layer. The interface layer can include an inner face, secured to the second pad face, and an outer face. The back-up apparatus can also include a layer of a first adhesive on the outer face and extending into the interface layer, and a layer of a second adhesive provided on the layer of the first adhesive. The second adhesive can be selected to releasably adhesively bond to an abrasive sheet. The first and second adhesives can be selected such that the adhesive bond between the first adhesive and the second adhesive is stronger than the adhesive bond between the second adhesive and the abrasive sheet whereby the layer of second adhesive remains bonded to the layer of first adhesive when the abrasive sheet is separated from the back-up apparatus.

The back-up pad can resiliently flexible and the interface layer is flexible whereby the back-up pad flexes to follow the contours of a surface being sanded.

The interface layer can be a pile material and the outer face can include a plurality of engagement fibres extending away from the interface layer.

The first adhesive can be mechanically worked into the interface layer and can extend below the outer face to provide a three dimensional adhesive layer.

The interface layer can cover substantially all of the outer face.

The surface area of the interface layer can be greater than the surface area of the pad mounting face of the back-up plate.

The back-up pad can be a natural or synthetic rubber.

The bond between the second adhesive and the abrasive sheet can have a first bond strength at 25° C. and a second bond strength at 400° C. The second bond strength can be at least 80% of the first bond strength.

The back-up plate can include a plurality of plate suction apertures fluidly connectable to a suction housing. The back-up pad can also include a plurality of pad suction apertures in fluid communication with the plurality of plate suction apertures and the interface layer can include a plurality of interface suction apertures in registration with the pad suction apertures.

The back-up plate can include a plurality of plate suction apertures fluidly connectable to a suction housing, the back-up pad comprises an open pad suction channel in fluid communication with the plurality of plate suction apertures and opening to the second pad face and the interface layer comprises an interface suction opening registered with the pad suction channel.

Also in accordance with this aspect, a method of replacing an abrasive sheet on a back-up apparatus can include the step of providing a back-up apparatus having, a back-up plate having a pad attachment face and a back-up pad. The back-up pad can have a first pad face secured to the pad attachment face, and an opposed second pad face. The back-up apparatus can also include a porous interface layer having an inner face secured to the second pad face, and an opposed outer face. The back-up apparatus can also include a layer of a first adhesive covering the outer face and coating a plurality of discrete fibres extending away from the abrasive mounting face, and a layer of a second adhesive provided on the first adhesive and releasably adhesively bonded to the abrasive sheet. The method can also include the steps of separating the abrasive sheet from the interface layer; providing a replacement abrasive sheet comprising a first side covered with abrasive material and an opposed second side configured to releasably engage the layer of second adhesive; aligning the second side of the replacement abrasive sheet with the abrasive mounting face of the interface layer; and pressing the second side of the replacement abrasive sheet against the layer of second adhesive on the interface layer.

The abrasive sheet can include a base layer. The base layer can provide the first side covered with abrasive material, and can include an opposed rear face. The abrasive sheet can also include a film layer bonded to the opposed rear face of the base layer. The film layer can include the opposed second side configured to releasably engage the layer of second adhesive.

The step b) may be completed in the absence of transferring the second adhesive from the abrasive mounting face to the abrasive sheet.

The method can also include sealing the peripheral edges of the film layer to the abrasive mounting face whereby debris is inhibited from being deposited between the abrasive mounting sheet and the film layer.

The film layer can be mylar.

The back-up pad can be resiliently flexible and the interface layer is also flexible whereby the interface layer flexes with the back-up pad In accordance with another aspect of the invention, which may be used by itself or with any one or more other aspects of the invention, the back-up apparatus can have an open sided channel in the outer face thereof, the open sided channel is configured to connect a plurality of suction openings in an abrasive sheet in fluid communication with a source of suction. For example, the open sided channel may overlie at least two suction openings in an abrasive sheet and, preferably, may overlie all of the suction openings in an abrasive sheet. Accordingly, the rotational alignment of the abrasive sheet during the mounting of the abrasive sheet to the back-up pad may be simplified and optionally may be eliminated.

Optionally, a surface treating apparatus can be configured to include a suction system. The suction system can be operable to extract dust and other particulate matter from the region between the abrasive sheet and the surface being sanded. Removing debris from the surface using the suction system may help inhibit clogging or fouling of the abrasive sheet, and may help improve sanding performance.

Providing an open suction channel may eliminate the need for rotationally aligning the abrasive sheet with the back-up pad when placing the sheet on the pad. It may also help balance the suction applied to the plurality of suction holes in the abrasive sheet.

In accordance with this aspect, a back-up apparatus can include a back-up plate having a pad attachment face, an opposed rear face and at least one plate suction aperture extending through the back-up plate. The back-up apparatus can also include a back-up pad having a first pad face provided on the pad attachment face, and second pad face for supporting an abrasive sheet. A suction channel can be formed in the back-up pad, and can be in fluid communication with the at least one plate suction aperture. The suction channel can be registrable with a plurality of discrete suction apertures in an abrasive sheet.

The back-up apparatus can also include an interface layer comprising an inner face, fixedly fastened to the second pad face, and an opposed abrasive mounting face. The interface layer can include an interface suction opening registered with the open suction channel.

The suction channel can include a channel endwall disposed longitudinally between the second pad face and the first pad face, a first channel sidewall extending from the channel endwall to a first channel edge on the second pad face and an opposed second channel sidewall extending from the channel endwall to a second channel edge on the second pad face.

The first and second channel edges can be separated by a channel width, that is equal to or greater than an aperture width of the plurality of plurality of plate apertures. Optionally, the channel width can be between about 5 and about 15% of the diameter of the back-up pad.

The channel endwall can be positioned intermediate the abrasive mounting face and the first pad face.

The suction channel can extend through the back-up pad, from the second pad face to the first pad face and the channel endwall can include a portion of the pad attachment face of the back-up plate.

The suction channel can be generally circular as viewed from the abrasive mounting face and can be a continuous channel.

The back-up apparatus can include a central axis and the first and second channel edges can be concentric and centered about the central axis.

The suction channel can be generally U-shaped and can open toward the second pad face.

The back-up pad can be formed from a resiliently flexible material and can flex to follow surface contours of a surface being sanded.

The suction channel can have an open side on the second pad face that extends along the second pad face so as to be registerable with at least two of the suction apertures in the abrasive sheet.

In accordance with another aspect of the invention, which may be used by itself or with any one or more other aspects of the invention, a surface treating apparatus can include a suction apparatus that is spaced apart from the back-up apparatus be a suction spacing distance, and the suction spacing distance can be adjustable. Adjusting the suction spacing distance can help regulate the amount of suction applied via the back-up apparatus. Varying the amount of suction that reaches the surface being treated may be desirable. If the applied suction is too strong, the back-up apparatus may become non-rotatably stuck to the surface being treated. This may inhibit the surface treating operation and may mar or otherwise damage the surface. If the applied suction is too weak, it may be ineffective at capturing dust and debris generated by the surface treating process.

Optionally, the suction spacing distance can be configured to encourage at least some suction air flow to enter the suction housing via the gap between the housing and the back-up plate. In this configuration, the suction apparatus may be able to capture dust and debris escaping from the perimeter of the back-up apparatus, and draw the debris into the suction housing. This type of suction can be used in combination with the suction passages that extend through the back-up apparatus.

Optionally, the surface treating apparatus can include one or more spacer elements that can be positioned between the back-up plate and the driving apparatus. By varying the number of spacer elements used, the distance between the back-up plate and the driving apparatus can be modified. If the suction housing is mounted on the driving apparatus, changing the distance between the back-up plate and the driving apparatus also changes the distance between the back-up plate and the first edge.

Alternatively, or in addition, the suction apparatus can be adjustable such that an edge of the suction apparatus is moveable relative to the driving apparatus, and the back-up apparatus. Moving the edge of the suction apparatus closer or farther from the back-up apparatus may decrease or increase the suction spacing distance, respectively, which may increase or decrease, respectively, the amount of suction.

In accordance with yet another aspect of the invention, which may be used by itself or with any one or more other aspects of the invention, a back-up apparatus can be provided with one or more internal air suction conduits configured to connect at least one suction opening in an abrasive sheet in fluid communication with a source of suction, for example the suction apparatus. The internal suction conduits can extend through the interior of the back-up apparatus, and can connect suction apertures in the outer face of the back-up pad with suction apertures in the back-up plate. Optionally, the apertures in the outer face back-up pad can be radially outboard of the suction apertures in the back-up plate and the internal suction conduits can extend therebetween in a generally radial direction. If the back-up apparatus is used in rotary applications, for example grinding, it can be desirable to position the back-up pad suction apertures toward the edge of the back-up pad. This configuration may help capture dust and debris that is directed toward the edge of the spinning back-up apparatus.

In a particularly preferred embodiment, an internal channel can be utilized in combination with one or more open channels. Providing internal suction conduits may facilitate suction of debris through the back-up apparatus.

In some instances, it may be desirable to use a common suction apparatus in combination with multiple, differently sized and/or configured back-up apparatuses. In such instances, it may be desirable to configure the back-up apparatuses to have their suction outlets (e.g. plate suction apertures) in a generally similar, or generally the same configuration that is compatible with the configuration of the suction apparatus inlet. Internal suction conduits that extend in the generally radial direction may be used to fluidly connect a variety of differently sized and positioned back-up pad suction apertures (for example apertures that are radially outboard the sidewalls of the suction housing) to plate suction apertures that are positioned in a desired, standardized configuration (for example radially inboard of the suction housing sidewall).

Optionally, the back-up apparatus can also include an internal suction plenum that is in airflow communication with some or all of the internal suction conduits. The suction plenum can also be in air flow communication with the back-up pad suction apertures and back-up plate suction apertures. Providing a suction plenum may help equalize the suction in each of the internal conduits.

In accordance with at least some of these aspects, a back-up apparatus can include a back-up plate having a pad attachment face and a longitudinally opposed rear face. The back-up plate can include a central axis and a plate suction aperture extending through the back-up plate. The back-up apparatus can also include a back-up pad, having a first pad face, provided on the pad attachment face and a second pad face for supporting an abrasive sheet. The back-up pad can include a pad suction inlet in the second pad face. The back-up apparatus can also include an internal suction conduit extending transversely through the back-up pad and connecting the pad suction inlet with the plate suction aperture.

The plate suction aperture an be radially spaced apart from the central axis by a first radial distance and the suction inlet can be radially spaced apart from the central axis by a second radial distance. The second radial distance can be greater than the first radial distance. The internal suction conduit can include an upstream end in fluid communication with the suction inlet and a downstream end in communication with the plate suction aperture for communication of sanding waste through the back-up apparatus. The internal suction conduit can be positioned longitudinally intermediate the first and second pad faces.

The back-up apparatus can also include an interface layer comprising an inner face, fixedly fastened to the second pad face, and an opposed abrasive mounting face, the interface layer can have an interface suction aperture registered with the suction inlet in the second pad face.

The internal suction conduit can include a first end wall adjacent and spaced apart from the first pad face, an opposed second end wall adjacent and spaced apart from the second pad face and at least one sidewall extending between the first end wall and the second end wall.

The back-up apparatus can also include a plurality of pad suction inlets that are spaced apart from each other along a first circumference and a plurality of plate suction apertures that are spaced apart from each other along a second, smaller circumference.

The back-up apparatus can also include a plurality of internal suction conduits wherein an upstream end of each internal suction conduit can be in fluid communication with one pad suction aperture and a downstream end of each internal suction conduit can be in fluid communication with one plate suction aperture.

The suction inlet can include an open suction channel provided in the second pad face and in fluid communication with at least one internal suction conduit.

The upstream end of each internal suction conduit can be in fluid communication with one pad suction aperture and the downstream end of each internal suction conduit can be in fluid communication with the suction channel.

The upstream end of each internal suction conduit can be in fluid communication with the suction channel and the downstream end of each internal fluid conduit can be in fluid communication with the at least one plate suction aperture.

The back-up apparatus can also include an internal suction plenum within the back-up apparatus and in fluid communication between the plate suction aperture and the pad suction inlet.

The internal suction plenum can be in fluid communication with the plate suction aperture and each internal suction conduit can have an upstream end in fluid communication with one pad suction inlet and a downstream end in fluid communication with the internal suction plenum.

The internal suction plenum can be in fluid communication with each of the plate suction apertures and the downstream end of each internal suction conduit.

The internal suction plenum can be a continuous channel.

In accordance with at least some of these aspects, a surface treating apparatus can include a driving apparatus and a back-up apparatus mounted on the driving apparatus and comprising a back-up plate and a back-up pad. The back-up plate can have a pad attachment face and a longitudinally opposed rear face. The back-up plate can include a central axis and a plate suction aperture extending through the back-up plate. The back-up pad can have a first pad face, secured to the pad attachment face, and a second pad face for supporting an abrasive sheet. The back-up pad can include at least one of pad suction inlet in the second pad face. The surface treating apparatus can also include an internal suction conduit extending transversely through the back-up pad and connecting the pad suction inlet with the plate suction aperture. The surface treating apparatus can also include a suction housing mounted on the driving apparatus. The suction housing can have a housing sidewall radially surrounding the at least one plate suction aperture and a housing inlet adjacent to and fluidly connected to the at least one plate suction aperture to receive sanding waste from the back-up apparatus. The housing sidewall can be radially intermediate the at least one pad suction inlet and the at least one plate suction aperture.

The plate suction aperture can be radially spaced apart from the central axis by a first radial distance. The pad suction inlet can be radially spaced apart from the central axis by a second radial distance. The second radial distance can be greater than the first radial distance. The internal suction conduit can include an upstream end in fluid communication with the suction inlet and a downstream end in communication with the plate suction aperture for communication of sanding waste through the back-up apparatus. The internal suction conduit can be positioned longitudinally intermediate the first and second pad faces.

The surface treating apparatus can also include an interface layer that can have an inner face, fixedly fastened to the second pad face, and an opposed abrasive mounting face. The interface layer can include an interface suction aperture registered with the at least one suction inlet in the second pad face.

The at least one internal suction conduit can include a first end wall adjacent and spaced apart from the first pad face, an opposed second end wall adjacent and spaced apart from the second pad face and at least one sidewall extending between the first end wall and the second end wall.

The at least one suction inlet can include a plurality of pad suction apertures spaced apart from each other along a first circumference and the at least one plate suction aperture can include a plurality of plate outlet apertures spaced apart from each other along a second, smaller circumference. Each pad suction aperture can be fluidly connected to at least one of the plate outlet apertures by a corresponding one of the at least one internal suction conduits.

The upstream end of each internal suction conduit can be in fluid communication with one pad suction aperture and the downstream end of each internal suction conduit can be in fluid communication with one plate suction aperture.

The at least one suction inlet can include an open suction channel provided in the second pad face and in fluid communication with the at least one internal suction conduit.

The upstream end of each internal suction conduit can be in fluid communication with one pad suction aperture and the downstream end of each internal suction conduit can be in fluid communication with the suction channel.

The upstream end of each internal suction conduit can be in fluid communication with the suction channel and the downstream end of each internal fluid conduit can be in fluid communication with the at least one plate suction aperture.

In accordance with another aspect of the invention, which may be used by itself or with any one or more other aspects of the invention, a surface treating apparatus that includes a suction system can be configured to be compatible for use in grinding operations and for use with fibre discs and other relatively aggressive abrasive media. The surface treating apparatus can include a back-up plate that is configured for use with fibre discs, and the like, and need not include a compliant, flexible back-up pad. To facilitate suction, the back-up plate and fibre disc can include suction apertures and suction holes or apertures, respectively. The suction apertures in the back-up plate can be through holes, or can be configured in any other suitable configuration, including, for example, having suction channels, conduits and plenums as described herein.

Conventional fibre disc sanding apparatuses do not include back-up apparatuses of the nature described herein. The stiffness of the fibre disc abrasive sheets can be sufficient to be used in grinding operations without the need for an external back-up apparatus. Also, in conventional grinding applications, the fibre disc abrasive is not intended to follow the contours of a surface being grinded, and the flexibility of the back-up pads described herein may be unnecessary. Further conventional fibre disc sanding apparatuses also do not include suction systems of the nature describe herein. Conventional fibre discs do not include suction holes, and the sanding apparatuses do not include suction housings, etc. Conventional fibre disc sanding apparatuses are operated without a back-up apparatus suitable for connection with a suction system. Further, the coarse nature of the abrasive material used on conventional fibre discs, and the nature of the surfaces being grinded, makes fibre discs less likely than conventional, fine grain sand paper to become clogged with sanding debris.

Forming suction holes in conventional fibre discs can result in accelerated wear on the forming tools (such as a press or die) due to the nature of the strong abrasive materials coating the fibre disc.

The inventor has discovered that fibre discs can be used in combination with a back-up plate. The inventor has also discovered that fibre discs can be provided with suction holes, and can be used in combination with a suction system. Providing a fibre disc mounted to a back-up plate, and/or equipped with suction holes may help improve the performance of the fibre disc.

In accordance with at least one of these aspects, a surface treating apparatus can include a back-up apparatus connectable to a driving apparatus and rotatable about a central axis. The back-up apparatus can include a back-up plate that can have an abrasive mounting face and an opposed rear face, and a plurality of plate suction apertures extending through the back-up plate. The surface treating apparatus can also include an abrasive fibre disc. The fibre disc can have an abrasive surface coated with abrasive material and an opposed mounting surface adjacent the pad attachment face of the back-up plate. The fibre disc can also include a central mounting aperture for receiving a mounting fastener for attaching the fibre disc to at least one of the back-up apparatus and the driving apparatus, and a plurality of disc suction apertures registered with corresponding ones of the plurality of plate suction apertures. The surface treating apparatus can also include a suction apparatus that can have a suction housing. The suction housing can include a suction housing inlet opposite the rear face of back-up plate and surrounded by a suction housing sidewall. The suction housing inlet can be in fluid communication with the plurality of plate suction apertures for extracting sanding waste through the fiber disc and back-up apparatus.

The plurality of disc suction apertures can be spaced apart from each other about the periphery of the fibre disc.

The plurality of disc suction apertures can be spaced an equal radial distance from the central axis of rotation.

The plurality of plate suction apertures can be radially inboard from the suction housing sidewall.

The suction apparatus can include a first edge that is spaced apart from the rear face of the back-up plate by a suction spacing distance. The first edge can be moveable relative to the back-up plate in a direction parallel to the central axis of rotation whereby the suction spacing distance can be altered to adjust the suction strength.

The suction apparatus can include a collar coupled to the suction housing and translatable relative to the suction housing. The collar can include the first edge.

The surface treating apparatus can also include a securing apparatus configured to secure the collar to the suction housing thereby inhibiting relative movement therebetween. The securing apparatus can include a clamp.

The suction housing can be longitudinally movably coupled to the driving apparatus, the suction housing comprising the first edge.

The first edge can be moveable while the back-up plate is rotating.

The disc suction apertures can include aperture sidewalls that are at least partially coated with the abrasive material.

The back-up plate can be rigid.

In accordance with at least one of these aspects, a method of manufacturing an abrasive fibre disc can include the steps of: a) providing a sheet of base material; b) forming the base material into a disc; c) forming a central mounting aperture in the centre of the disc; d) forming a plurality of discrete suction apertures in the disc; e) after forming the central mounting aperture and the plurality of suction apertures, coating at least one side of the disc with abrasive material.

The plurality of suction holes can be arranged on a common circumference.

The steps b), c) and d) can be carried out generally simultaneously.

In accordance with yet another aspect of the invention, which may be used by itself or with any one or more other aspects of the invention, a safety fastener can be used to secure an abrasive sheet to a surface treatment apparatus. Under certain operating conditions, for example high temperatures and/or high friction between the abrasive sheet and the surface being treated, there can be a risk that the abrasive sheet can separate from the back-up pad. For example, the primary attachment mechanism used to hold the abrasive sheet to the back-up apparatus, for example hook and loop fasteners and some conventional adhesives, can weaken over time, reducing the strength of the bond with the abrasive sheet. In some applications, it can be advantageous to provide a secondary, safety fastening mechanism to secure the abrasive sheet to the back-up pad. The safety fastening mechanism can be configured to keep the abrasive sheet attached to the surface treating apparatus in the event of a primary attachment mechanism failure.

Preferably, the safety fastening mechanism is releasable to facilitate changing and replacement of the abrasive sheets, and is re-usable. The back-up apparatus can be configured to receive the safety fastening mechanism.

In accordance with this aspect, a back-up apparatus can include a back-up plate having a pad attachment face and an opposed rear face. The back-up plate can include a central bore. The back-up apparatus can also include a back-up pad having a first pad face, provided on the pad attachment face, and a second pad face for supporting an abrasive sheet. The back-up pad can include a pad central opening registered with the central bore on the back-up plate. An abrasive sheet safety fastener can be releasably securable to the central bore and configured to secure an abrasive sheet to the back-up pad.

The back-up apparatus can also include an interface layer having an inner face, fixedly fastened to the second pad face, and an opposed abrasive mounting face. The interface layer can include an interface central aperture registered with the pad central aperture and adapted to receive the safety fastener.

The plate central bore can be internally threaded and the safety fastener can be a bolt having mating threads.

The threads in the central bore can be formed as part of the back-up plate, or can be provided by an anchor member that is connected to the back-up plate.

The safety fastener can extend through the back-up apparatus and can be engageable with a drive spindle on a driving apparatus.

The back-up apparatus can also include a washer positionable as an interface between the fastener and the abrasive sheet and mountable on the fastener for non-rotational movement with respect to the back-up pad as the fastener is secured in to the central bore whereby damage to the fastener from the abrasive material is inhibited.

The back-up apparatus can be configured so that a head of the fastener is recessible below a plane containing the abrasive mounting surface when the fastener is secured to the central bore.

The back-up pad can be compressible and is compressed when the safety fastener is tightened.

In accordance with another aspect of the invention, which may be used by itself or with any one or more other aspects of the invention, a mounting tool can be used to place an abrasive sheet on a corresponding back-up apparatus. Obtaining proper radial and rotational alignment between an abrasive sheet and a back-up apparatus can be challenging when the abrasive sheet is attached by hand. It can be advantageous to properly align the abrasive sheet on the back-up apparatus. Improper radial or lateral alignment can cause imbalances and vibrations when the surface treatment apparatus is use. Improper rotational alignment can result in improper registration of the suction holes in the abrasive sheet with the suction apertures in the back-up pad, which may impede suction performance. Placing the abrasive sheet on the back-up apparatus may be particularly challenging when the suction apparatus is active, as the suction from the pad suction apertures may tend to pull the abrasive sheet against the back-up pad before it can be properly aligned.

It may be advantageous to provide a mounting tool that can be used to assist a user when attaching an abrasive sheet to a back-up pad, particularly when the abrasive sheet includes suction holes. It may be desirable to have a mounting tool that can be used when the suction apparatus is active.

For example, in instances when the back-up pad includes a plurality of discrete pad suction apertures in the abrasive mounting face (instead of or in addition to an open suction channel), it may be advantageous to use an abrasive sheet mounting tool to help facilitate placement of an abrasive sheet on the back-up pad. Alternatively, if the back-up pad includes an open suction channel, the mounting tool can be configured so that it is compatible with the open suction channel.

In accordance with at least one of these aspects, a tool for mounting an abrasive sheet having a plurality of sheet suction apertures arranged in a first pattern on a back-up pad comprising at least one corresponding pad suction inlet configured to be registered with the plurality of sheet suction apertures, can include a body that can include a handle portion. The tool and also include a plurality of alignment pins extending from pin attachment locations on the body. The plurality of alignment pins can be positioned to match the first pattern so that each one of the plurality of alignment pins can be aligned with a corresponding one of the plurality of sheet suction apertures to receive the abrasive sheet. Each support pin can be insertable into the at least one pad suction inlet while the abrasive sheet is supported on the alignment pins.

The alignment pins can be moveably mounted to the body.

The alignment pins can be securable to alternate pin attachment locations.

The body can include multiple sets of pin attachment locations corresponding to multiple abrasive sheet suction aperture patterns whereby the alignment pins can be positioned to match the plurality of different sheet suction aperture patterns.

Each alignment pin can extends from a first end proximate the body to a second distal end. The distal end of each alignment pin can be contoured to facilitate insertion of the pins into the pad suction apertures.

The tool can include three alignment pins arranged in a generally triangular configuration.

The alignment pins can lie on a common circumference.

The cross-sectional shape of each alignment pin can correspond to a shape of the sheet suction apertures.

The alignment pins can be sized to be smaller than the abrasive sheet suction apertures so that the abrasive sheet can slide along the length of the alignment pins when the alignment pins are inserted into the at least one pad suction inlet.

The plurality of alignment pins can be sized to be freely removable from both the abrasive sheet suction apertures and the at least one pad suction inlet when the abrasive sheet is attached to the back-up pad.

In accordance with at least one of these aspects, a method of mounting an abrasive sheet having a plurality of sheet suction apertures on a back-up pad comprising a at least one corresponding pad suction inlet can include the steps of a) aligning at least a portion of the sheet suction apertures with alignment pins on a mounting tool; b) sliding the abrasive sheet onto the mounting tool; c) aligning the alignment pins with the at least one pad suction inlet and inserting the alignment pins therein, thereby aligning the plurality of sheet suction apertures with the plurality of pad suction apertures; d) securing the abrasive sheet to an abrasive mounting face of the back-up pad; and e) removing the alignment pins from the respective ones of the pad suction apertures.

The method can include the step of positioning the alignment pins on the mounting tool to align so as to be allignable with the suction sheet apertures.

In accordance with another aspect of the invention, which may be used by itself or with any one or more other aspects of the invention, a back-up apparatus can include a back-up plate that is generally planar. Optionally, the back-up plate can be free from integrated hardware. Conventional back-up plates tend to have 3D, or non-planar configurations, and are formed from injection molded plastic. Mounting hardware is often molding into the part. The rear surfaces of conventional back-up plates can vary from plate to plate, and between sizes of back-up apparatuses. The differences in the configuration of the back-up plates can make it difficult to provide a suction apparatus that is compatible with multiple styles and sizes of back-up apparatus, optionally for different purposes.

Injection molding back-up plates can be relatively expensive. Design changes to molded back-up plates can require changes to the corresponding molds, dies etc. Forming back-up plates from a planar sheet of material can be relatively lower cost than injection molding, and can allow for increased design flexibility.

In the examples describe previously, the back-up plate is generally more rigid than the back-up pad. Optionally, the back-up plate can be formed from molded plastic. In such a configuration, the back-up plate may have a curved, three-dimensional rear face (facing away from the back-up pad).

Alternatively, according to this aspect, the back-up plate can be a generally planar member, having a generally planar, or two-dimensional, rear face. Providing a planar rear face may help reduce the amount of material required to form the back-up plate.

Providing a planar rear face may also help standardize the axial dimensions/configurations of different sized back-up plates. Standardizing the size and shape of the rear face may help facilitate the use of the same auxiliary equipment, such as the suction housing, with a variety of back-up plates of different sizes. This configuration may allow a user to quickly change the back-up apparatus on a sanding apparatus (for example from an eight inch grinding abrasive to a six inch sanding abrasive) without having to adjust or reconfigure the suction housing, and optionally other equipment.

Planar back-up plates may also be easier and/or less expensive to manufacture than an analogous mold plastic back-up plate. The material used in the planar back-up plate can be selected that it is more warp resistant than conventional molded back-up plates. The back-up plate can be formed in any suitable shape for use with a variety of surface treating apparatuses, and need not be limited to circular or disc-like plates.

In accordance with this aspect, a back-up apparatus can include a back-up plate having a planar pad attachment face, a parallel, opposed planar rear face, and a central plate aperture sized to removably receive a mounting fastener. The back-up apparatus can also include a back-up pad having a first pad face, provided on the pad attachment face, and a second pad face for supporting an abrasive sheet, and a central pad aperture extending from the first pad face to the second pad face and registered with the central plate aperture. The central pad aperture can be sized to removably receive the mounting fastener.

The plate can be formed from a rigid composite material.

The plate can have a tensile strength of between about 40 MPa to about 80 MPa and a Young's modulus of between about 1.8 GPa and about 2.5 GPa.

The plate can be formed from polycarbonate.

Also in accordance with this aspect, a method of manufacturing a back-up plate can include the steps of: a) providing a planar sheet of plate material; b) forming a back-up plate from the sheet of plate material; and c) forming a central mounting aperture in the back-up plate to accommodate a mounting fastener.

Step b) can include cutting the back-up plate from the planar sheet.

The back-up plate can have a plate radius and the method can include selecting the plate radius to be smaller than a pad radius of a back-up pad that is to be coupled to the back-up plate.

The method can also include forming a plurality of plate suction apertures in the back-up plate.

The steps of forming the back-up plate, forming a central mounting aperture and forming the plurality of plate suction apertures can be performed substantially simultaneously.

Also in accordance with this aspect, a method of manufacturing a back-up apparatus can include the steps of: a) providing a back-up pad having a pad radius and a central pad aperture; b) providing a planar sheet of plate material; c) forming a back-up plate having a plate radius from the sheet of plate material the plate radius being equal to or smaller than the pad radius; d) forming a central plate aperture in the back-up plate to accommodate a mounting fastener; e) applying adhesive to a least one of a first pad face of the back-up pad and a pad attachment face of the back-up plate; f) aligning the first pad face of the back-up pad and the pad attachment face so that the central pad aperture is registered with the central plate aperture; and, g) bonding the first pad face to the pad attachment face.

In accordance with another aspect of the invention, which may be used by itself or with any one or more other aspects of the invention, an auxiliary member can be positioned between the back-up pad and the abrasive sheet. The auxiliary member can be permanently or removably attached to the back-up apparatus. Providing an auxiliary member can allow a user to modify the properties of the back-up apparatus. One example of an auxiliary member is a sponge member that is generally softer and more compliant than the back-up pad to which it is mounted.

DRAWINGS

The drawings included herewith are for illustrating various examples of articles, methods, and apparatuses of the teaching of the present specification and are not intended to limit the scope of what is taught in any way.

Figure 1:
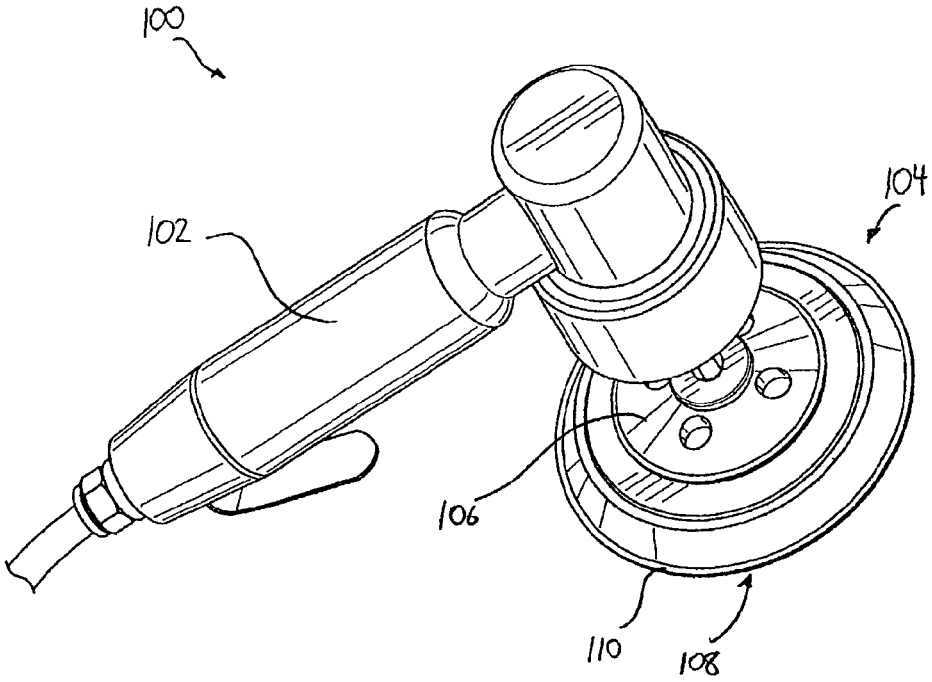
FIG. 1 is a perspective view of a sanding apparatus.

Elements shown in the figures have not necessarily been drawn to scale. Further, where considered appropriate, reference numerals may be repeated among the figures to indicate corresponding or analogous elements.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

A surface treating apparatus can be used for treating a surface, for example by sanding, grinding, polishing and the like. Examples of surface treating apparatuses, and methods for using such apparatuses are described below. The term surface treating apparatus can include sanders, grinders, polishers, buffers and any other like apparatus. For simplicity, embodiments described below by way of example may be described as sanding apparatuses or grinding apparatuses, etc, but the features described as being incorporated into a "sanding apparatus", for example, can also be incorporated into other suitable surface treating apparatuses, and vice versa.

Structure of a Sanding Apparatus

Figure 2:
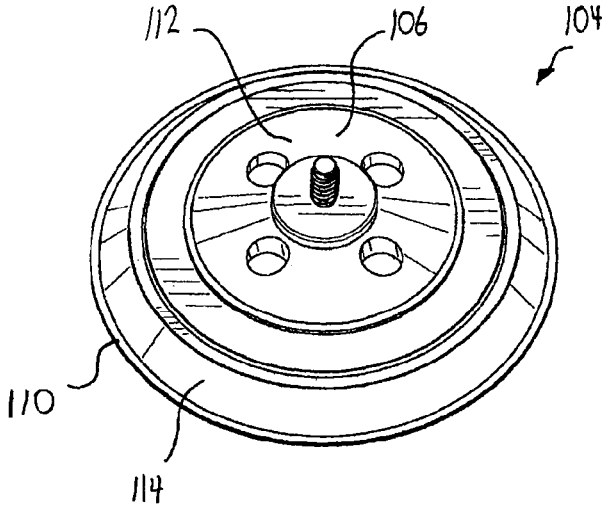
FIG. 2 is a rear perspective of a back-up apparatus from the sanding apparatus of FIG. 1.

Referring to FIGS. 1 and 2, an example of a sanding apparatus 100 includes a driving apparatus 102 and a back-up apparatus 104. The back-up apparatus 104 has a rear face 106 (facing the driving apparatus) and an opposed abrasive mounting face 108. An abrasive sheet 110 is releasably attachable to the abrasive mounting face 108. The releasable engagement between the abrasive sheet 110 and the abrasive mounting face 108 may help facilitate the replacement of a used or worn abrasive sheet 110 with a new, replacement abrasive sheet 110 or an abrasive sheet with a different grit.

In the illustrated example, the abrasive sheet 110 is attached to the abrasive mounting face 108 using a releasable, reusable adhesive. Alternatively, the abrasive sheet 110 can be attached to the abrasive mounting face 108 using any suitable, releasable fastener including, for example, adhesives and mechanical fasteners (including, for example, hook and loop fasteners or a locking clamp).

The driving apparatus 102 can be any suitable type of driving apparatus that is compatible with the back-up apparatus, including, for example a rotary driving apparatus (including, for example electric and air-powered rotary drivers and grinders), and a double action driving apparatus.

The abrasive sheet 110 can be any suitable type of surface treating product that is used to treat a surface, such as by sanding, grinding, polishing or buffing a surface, including, for example, sand paper, resin cloth abrasive discs, fiber discs, and waterproof sandpaper and other like surface treatment products. Accordingly, as used herein, the term sanding apparatus relates to any apparatus that is used in combination with a suitable abrasive material, including, for example, sanders, grinders, polishers and buffers, and is not limited apparatuses equipped with conventional sand paper. It will be appreciated that while abrasive sheet may be disc shaped as exemplified, it may be any other shape, such as square or rectangular is used with a double action driving apparatus.

Figure 3:
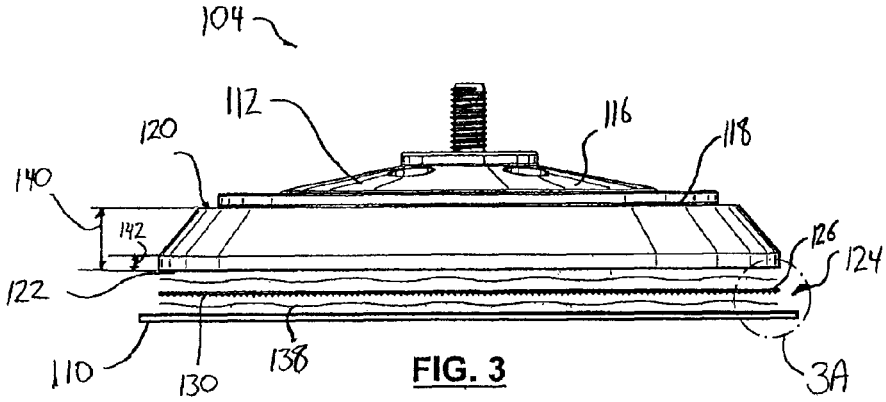
FIG. 3 is a partially exploded side view of the back-up apparatus of FIG. 2.

Referring to FIGS. 2 and 3, in the illustrated example the back-up apparatus 104 includes a back-up plate 112 and a back-up pad 114.

The back-up plate 112 has a back face 116 and an opposed pad attachment face 118. In the illustrated example, the back face 116 of the back-up plate 112 comprises the rear face 106 of the back-up pad 104. The pad attachment face 118 is adapted to be coupled to the back-up pad 114. Preferably, the back-up plate 112 is formed from a relatively rigid material, including, for example, metal, plastic and composite materials.

The back-up pad 114 is preferably formed from a material that is relatively more flexible than the back-up plate 112. For example, in the illustrated embodiment the back-up pad 114 is made from a resiliently flexible material such as a natural or a synthetic rubber.

The back-up pad 114 includes a first pad face 120 and an opposed second pad face 122. The first pad face 120 abuts the pad attachment face 118 of the back-up plate 112. Preferably, the first pad face 120 is permanently attached to the pad attachment face 118, for example, by a layer of permanent adhesive. Optionally, the second pad face 122 can be coupled to directly to an abrasive sheet 110, or, in accordance with one aspect of this specification, to an interface layer 124, which may be directly bonded to the abrasive sheet 110. Examples of suitable interface layers include a mechanical attachment layer (e.g. a layer comprising hooks or loops of a hook and loop fastener system) and an adhesive interface layer.

Interface Layer

In accordance with one aspect of this specification, which may be used by itself or with any one or more other aspects of this specification, an interface layer is used to secure an abrasive sheet 100 to a back-up pad 114. The back-up pad 114 provides a mounting support for the abrasive sheet 110 and, preferably, provides a cushioned backing. During use, an abrasive sheet is subjected to substantial forces in the plane of the abrasive sheet. If the adhesive used to secure the abrasive sheet in place is too weak, then the sheet may become dislodged during use and this may mar or otherwise spoil the surface being treated. If the adhesive is too strong, it may be difficult to remove worn abrasive sheets from the back-up pad, and/or portions of the abrasive sheet may tear and remain fixed to the back-up pad. An advantage of the interface layer is that it may provide a stronger, releasable attachment of the abrasive sheet to the back-up pad.

Figure 3A:
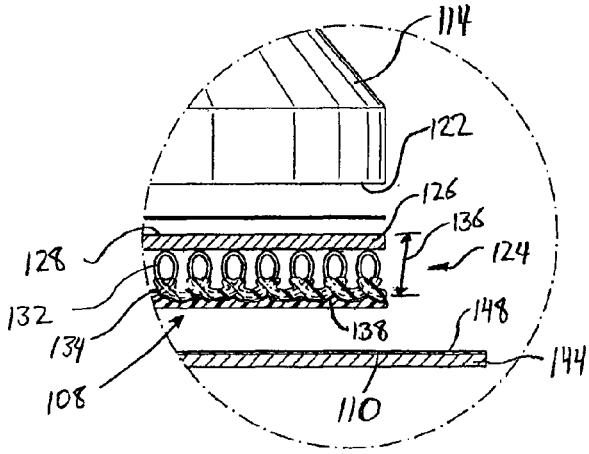
FIG. 3A is a detail view of region 3A shown in FIG. 3.

Referring also to FIG. 3*a*, in the illustrated example, the back-up apparatus 104 includes an adhesive interface layer 124. The adhesive interface layer 124 includes, and preferably is, a porous sheet 126. The porous sheet 126 has an inner face 128 that may be permanently glued or otherwise secured to the second pad face 122, and an opposed outer face 130 that can be releasably attached to the abrasive sheet 110. The interface layer 124 is preferably flexible so as to move and flex with the back-up pad 114 during use. In this example, the outer face 130 of the interface layer forms the abrasive mounting face 108 of the back-up apparatus 104.

The porous sheet 126 has a surface that is textured thereby providing spaces that are recessed in the Z direction (which can be generally perpendicular to the plane comprising the abrasive mounting face 108) for receiving an adhesive applied thereto. An advantage of porous sheet 126 an adhesive may penetrate into the openings in the porous sheet 126 and thereby provide a greater surface area for the adhesive to be secured to porous sheet 126. The interface layer may absorb the base adhesive such that the adhesive extends at least partially into the interface layer and coats its fibres. Accordingly, some or all of the fibres in the interface layer may be saturated or coated with the base adhesive.

Preferably, the porous sheet 126 is a lofty or pile fabric material that has a plurality of individual fibres 132 extending away from the outer face 130. An example of such a material is a loop material such as may be used in a hook and loop fastener system. Examples of other suitable materials include felt, wool-based fabrics and cotton-based fabrics, or any other material that has fibres provided on at least one surface of a substrate.

To provide a re-usable, releasably adhesive surface suitable for bonding to the abrasive sheet 110, the abrasive mounting face 108 is coated with at least one and preferably two discrete adhesive layers.

To manufacture a suitable adhesive interface layer 124, the abrasive mounting face 108 may be first coated with a layer of a first or base adhesive 134. The base adhesive 134 can be a partially setting adhesive and may be applied over all or substantially all of the abrasive mounting face 108. Preferably, the base adhesive 134 is then mechanically worked into the porous sheet 126, such as by brushing and/or rolling the base adhesive into the porous sheet 126. Working the adhesive into the porous sheet 126 may help coat the individual loop fibres 132 extending from the outer face 130 and may provide a three-dimensional adhesive coating, for example, a coating that covers the surface of the outer face 130 and permeates at least partially into the thickness 136 of the porous sheet 126. Coating the fibres 132 in this manner may help increase the available adhesive surface area of the base adhesive layer 134, and may help strengthen the adhesive bond between the base adhesive layer 134 and the porous sheet 126 (for example, as compared to a conventional "surface" or two-dimensional coating of adhesive).

After working the base adhesive 134 into the porous sheet 126, the adhesive interface layer 124 can be allowed to dry to at least partially set or cure the base adhesive 134. Preferably, the adhesive interface layer 124 is allowed to dry until the base adhesive 134 is fully cured.

The base adhesive may be any adhesive that may flow or be worked into the openings in porous sheet 126.

When the base adhesive 134 is sufficiently cured, a layer of a second or tacky adhesive 138 may be applied over the base adhesive 134.

Optionally, the base and tacky adhesives 134, 138 are selected so that they are compatible with each other, such that the tacky adhesive 138 will firmly and permanently bond with the base adhesive 134. Applying the tacky adhesive 138 after the base adhesive 134 has at least partially cured may help inhibit mixing of the adhesives 134, 138 while they are wet.

The tacky adhesive 138 can be any suitable adhesive that will bond with the base adhesive 134, and will remain sufficiently tacky to releasably bond to one or more abrasive sheets 110 for an extended period of time. For example, the tacky adhesive 138 can be selected so that under normal operating conditions, it can remain releasably and reusably tacky for several weeks, months or years, having been through a plurality of abrasive sheet changes.

The tacky adhesive 138 is also selected so that it maintains a sufficient degree of tackiness to prevent separation of the abrasive sheet when elevated to the expected operation temperatures of the back-up apparatus 104, which may be, for example, between about 25° C. and about 250° C. or between about 35° C. and about 100° C. (for example for light to medium sanding operations) and optionally between about 30° C. and about 500° C. to about 800° C. or higher (for example for heavy sanding or grinding operations). For example, the adhesive can be selected so that it maintains its bond strength when a steel material that is being grinded glows red hot. Preferably, the high-temperature bond strength between the tacky adhesive 138 and the abrasive sheet 110 is at least about 80% of the standard, or room temperature, bond strength, and preferably can be at least about 90% or 95% of the room temperature bond strength. The tacky adhesive may be any adhesive that is suitable for bonding with the back of the abrasive sheet, and is preferably a Mylar® compatible adhesive if the abrasive sheet 110 includes a Mylar® film.

In addition, the tacky adhesive 138 is selected so that the strength of the adhesive bond between the base adhesive 134 and the tacky adhesive 138 is greater than the strength of the adhesive bond between the tacky adhesive 138 and the abrasive sheet 110. In this configuration, worn abrasive sheets 110 can be repeatedly peeled off of the abrasive mounting face 108 without transferring the tacky adhesive 138 from the interface layer 124 to the abrasive sheet 110.

In the illustrated example, the back-up pad 114 tapers towards its peripheral edge, and second pad face 122 has a larger surface area than the first pad face 120. In this configuration the back-up pad 114 thickness decreases from a first thickness 140 toward the centre of the back-up pad 114, to a second, thinner thickness 142 toward the peripheral edge of the pad 114. Reducing the thickness at the edge of the back-up pad 114 may help increase the flexibility of the peripheral portions of the back-up pad 114. In the illustrated example, the interface layer 124 is generally coterminous with the second pad face 122, and has a surface area that is greater than the first pad face 120.

Figure 4:
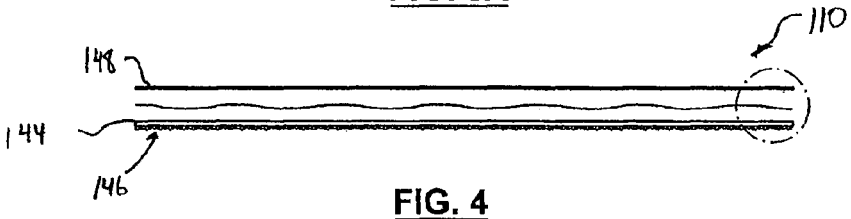
FIG. 4 is a partially exploded side view of an abrasive sheet useable with the back-up apparatus of FIG. 3.
Figure 4A:
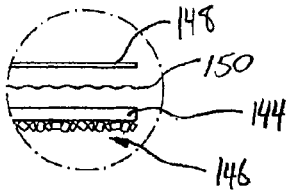
FIG. 4A is a detail view of region 4A in FIG. 4.

Referring to FIGS. 4 and 4A, an abrasive sheet 110 that is suitable for use with the adhesive interface layer 124 described above includes a base sheet 144, a layer of abrasive material 146 coated on one side of the base sheet and a film layer 148 bonded to the opposed side of the base sheet 144. The base sheet 144 can be any suitable material, including for example, paper and cloth.

The film layer 148 is permanently bonded to the base sheet 144, for example using adhesive layer 150. Adhesive layer 150 may be any adhesive that is compatible with both the base sheet 144 material and the film later 148 material used in a given abrasive sheet, to permanently bond the base sheet 144 to the film layer 148.

The film layer 148 provides a mounting surface, which is preferably smooth, for bonding to the abrasive mounting face 108 on the adhesive interface layer 124. Preferably, the film layer 148 and the tacky adhesive 138 are mutually selected such that the film layer is releasably securable to the tacky adhesive. For example, the tacky adhesive may act like contact cement formulated to be provided on only one surface. Optionally, an adhesive, which is releasably securable to the tacky adhesive 138, may be applied to the inner surface of the film layer 148

In the illustrated example, the bond between the tacky adhesive 138 and the film layer 148 has sufficient strength to retain the abrasive sheet 110 during use, without requiring any additional adhesive material to be provided on the film layer 148. In this example, the abrasive sheets 110 can be manufactured without having any exposed adhesive on the outer surface of the film layer 148. This may eliminate the need for providing release cover sheets, for example wax paper sheets, on the back of the abrasive sheets 110, as is generally required when producing and handling adhesive-coated abrasive sheets.

Preferably, the film layer 148 is made from Mylar®, nylon or another similar strong plastic-like material that can provide a satisfactorily smooth mounting face. Providing a rough surface to contact the tacky adhesive 138 may undesirably increase the strength of the adhesive bond between the abrasive sheet 110 and the tacky adhesive 138. The required degree of smoothness of the film layer 148 is selected based on the properties of the tacky adhesive used, so that the bond between the film layer 148 and the tacky adhesive 138 is weaker than the bond between the tacky adhesive 138 and the base adhesive 134.

Providing a smooth mounting face may help control the strength of the adhesive connection between the film layer 148 and the interface layer 124. Providing a smooth surface may also help seal the connection between the abrasive sheet 110 and the interface layer 124, to inhibit the admission of dust and other debris between the film layer 148 and the interface layer 124.

The material of the film layer 148 can be selected such that it is stronger than the base layer 144 of the abrasive sheet 110. Providing a relatively stronger film layer 148 may help increase the overall strength of the abrasive sheet 110 and may help limit tearing of the abrasive sheet 110 during use and when peeling a worn abrasive sheet 110 off of the adhesive interface layer 124.

To replace a worn abrasive sheet 110, a user can first separate the worn abrasive sheet 110 from the interface layer 124 by peeling the film layer 148 from the abrasive mounting face 108. The user can then align the film layer 148 of a replacement abrasive sheet 110 with the abrasive mounting face 108 of the interface layer 124, and pressing the film layer 148 against the interface layer 124 to secure the abrasive sheet 110 to interface layer 124. This process can be repeated for subsequent abrasive sheet 110 replacements.

Preferably, the abrasive sheet 110, including the film layer 148, is relatively flexible and can move and flex with the back-up pad 114, for example, to help follow the surface contours of an object or surface being sanded.

As an alternative to the adhesive interface layer 110 described above, a mechanical interface layer, such as a layer of "hook" material, can be used to support an abrasive sheet 110 that includes a layer of complimentary loop material, or vice versa.

Open Suction Channel

In accordance with another aspect of this specification, which may be used by itself or with any one or more other aspects of this specification, the back-up apparatus has an open sided channel in the outer face thereof, the open sided channel is configured to connect a plurality of suction openings in an abrasive sheet in fluid communication with a source of suction. For example, the open sided channel may overlie at least two suction openings in an abrasive sheet and, preferably, may overlie all of the suction openings in an abrasive sheet. Accordingly, the rotational alignment of the abrasive sheet during the mounting of the abrasive sheet to the back-up pad may be simplified and optionally may be eliminated.

Optionally, a surface treating apparatus can be configured to include a suction system. The suction system can be operable to extract dust and other particulate matter from the region between the abrasive sheet and the surface being sanded. Removing debris from the surface using the suction system may help inhibit clogging or fouling of the abrasive sheet, and may help improve sanding performance.

Figure 5:
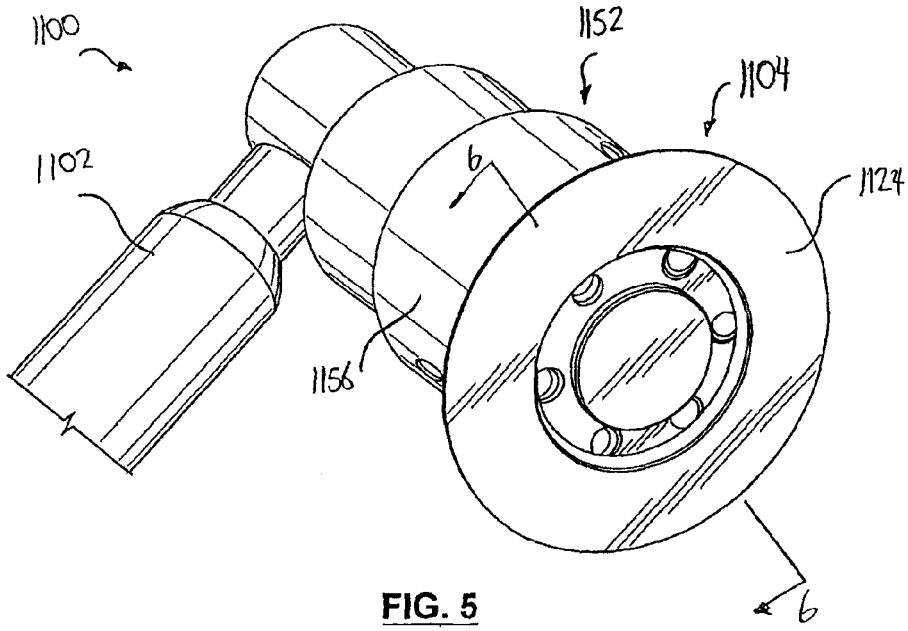
FIG. 5 is a perspective view of another example of a sanding apparatus.
Figure 6:
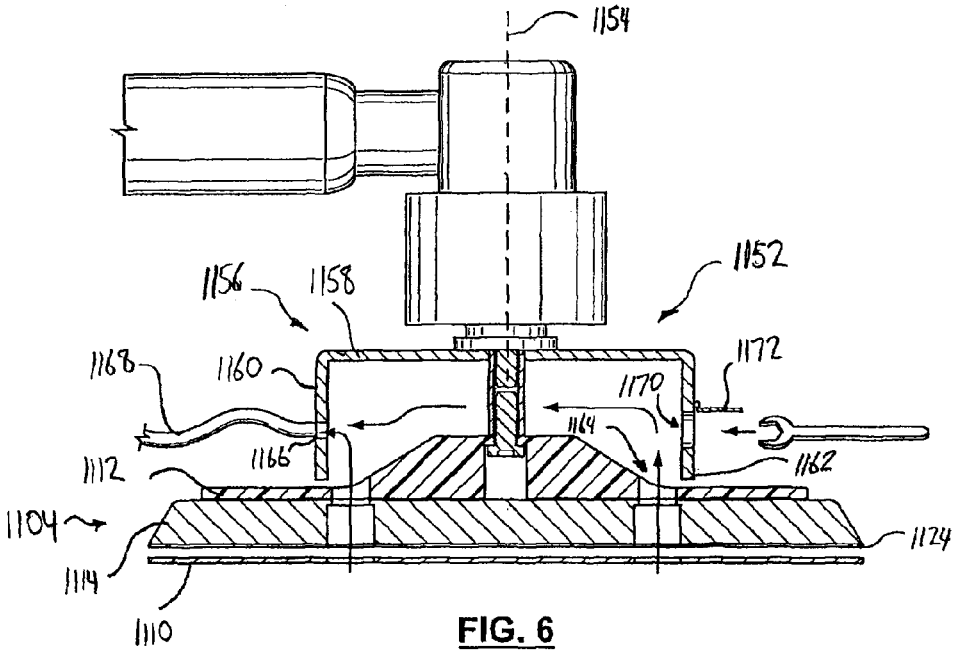
FIG. 6 is a section view take along line 6-6 in FIG. 5.

Referring to FIGS. 5 and 6, a sanding apparatus 1100 includes a driving apparatus 1102 a back-up apparatus 1104 and a suction apparatus 1152. The sanding apparatus 1100 may be generally similar to the suction apparatus 100, and like features are illustrated using like reference numerals starting at 1100. The sanding apparatus 1100 is a double action sanding apparatus, and the back-up apparatus 1104 has a central axis 1154.

In the illustrated example, the suction apparatus 1152 includes an optional suction housing 1156 that is mounted on the driving apparatus 1102. The suction housing 1156 can be non-movably fixed relative to the driving apparatus 1102, and includes a housing end wall 1158 and a housing sidewall 1160. The suction housing 1156 can be made from any suitable material having sufficient mechanical strength to resist the suction forces within the housing, including, for example, metal and plastic. The suction housing connects the suction outlets on the back-up apparatus to a source of suction and may be of any design known in the art.

As exemplified, the housing sidewall 1160 extends from the housing endwall 1158 toward the back-up apparatus 1104. The sidewall 1160 may be integral with the endwall 1158, or optionally, may be provided as a separate member. The region surrounded by the terminal edge 1162 of the suction housing 1156 defines a suction housing inlet 1164.

A suction housing outlet 1166 is provided in the housing sidewall 1160 (or alternatively in the housing endwall 1158 or any other suitable location). The suction outlet 1166 can be configured to be connectable to an external suction source, including, for example, a portable vacuum or a shop vacuum line 1168) and is in fluid communication with the suction housing inlet 1164. Optionally, a suction control member (not shown) can be positioned upstream from the suction housing outlet 1166. The suction control member can be used to regulate the suction supplied to the suction apparatus 1152, and can be any suitable apparatus, including, for example, a valve. Optionally, the suction control member can be operable to completely shut off the suction supplied to the suction apparatus 1152.

In some instances it may be desirable to provide access to the interior of the suction housing 1156. Accessing the interior of the suction housing 1156 may facilitate attachment and removal of a back-up apparatus and/or allow for servicing, cleaning and maintenance. Accordingly, the suction housing 1156 may optionally include a maintenance opening 1170 in the housing sidewall 1160. The maintenance opening 1170 can allow a user to access the interior of the suction housing 1156, for example, to attach and/or detach the back-up apparatus 1104 from the driving apparatus 1102. Optionally, the maintenance opening 1170 can be covered with a movable cover 1172 (which may be all or part of a wall). A gasket or the like may be provided to provide an airtight seal between the cover and the opening.

Figure 9:
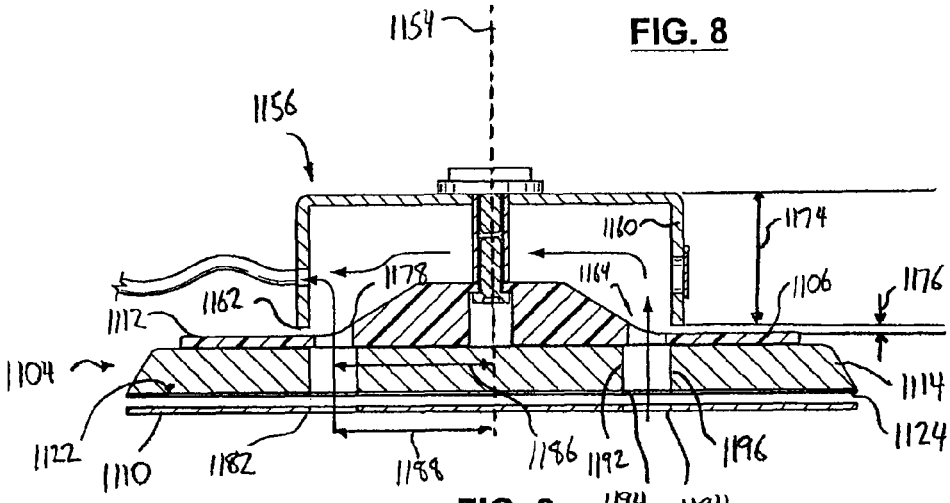
FIG. 9 is a section view taken along line 9-9 in FIG. 7.

Referring also to FIG. 9, the height 1174 of the suction housing sidewall 1160 can be selected so that the first edge 1162 of the suction apparatus 1156 is spaced apart from the back-up plate 1112 by a suction spacing distance 1176. In this configuration a gap is created between the terminal edge 1162 of the suction apparatus 1156 and the rear face 1106 of the back-up apparatus 1104. Providing a gap can help prevent contact between the suction apparatus 1156 and the back-up apparatus 1104, which may otherwise inhibit relative movement of the back-up apparatus 1104. The height 1176 of the gap can be selected so that contact with the back-up plate 1112 is avoided and air flow through the gap is sufficiently throttled to help ensure a useable amount of suction remains for extracting debris through the back-up apparatus 1104. The suction spacing distance 1176 can be between about 0.5 mm and about 15 mm, and is preferably between about 1 mm and about 10 mm.

Configuration of an Adjustable Suction Apparatus

In accordance with another aspect of this specification, which may be used by itself or with any one or more other aspects of this specification, the suction spacing distance can be adjustable. Adjusting the suction spacing distance can help regulate the amount of suction applied via the back-up apparatus. If the applied suction is too strong, the back-up apparatus may become non-rotatably stuck to the surface being treated. This may inhibit the surface treating operation and may mar or otherwise damage the surface. If the applied suction is too weak, it may be ineffective at capturing dust and debris generated by the surface treating process.

Optionally, the suction spacing distance can be configured to encourage at least some suction air flow to enter the suction housing via the gap between the housing and the back-up plate. In this configuration, the suction apparatus may be able to capture dust and debris escaping from the perimeter of the back-up apparatus, and draw the debris into the suction housing. This type of suction can be used in combination with the suction passages that extend through the back-up apparatus.

Optionally, the surface treating apparatus 1100 can include one or more spacer elements that can be positioned between the back-up plate 1112 and the driving apparatus 1102. By varying the number of spacer elements used, the distance between the back-up plate 1112 and the driving apparatus 1102 can be modified. If the suction housing 1156 is mounted on the driving apparatus 1102, changing the distance between the back-up plate 1112 and the driving apparatus 1102 also changes the distance between the back-up plate 1112 and the first edge 1162. Examples of suitable spacers include washer-like discs that can fit around the fastener used to secure the back-up apparatus to the driving apparatus spindle, and can abut both the spindle housing and the back-up apparatus.

Alternatively, or in addition, the suction housing 1156 can be adjustable such that the first edge 1162 is moveable relative to the driving apparatus 1102. Examples of suction apparatus having adjustable or moveable edges are set out below.

Figure 7:
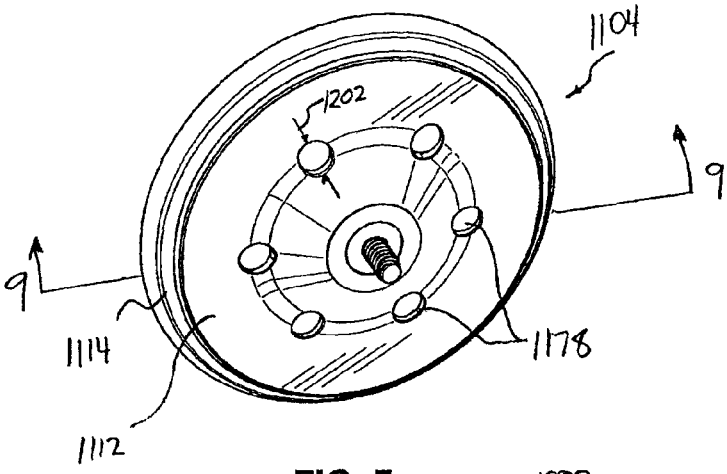
FIG. 7 is a rear perspective view of the back-up apparatus shown in FIG. 5.

The back-up apparatus 1104 includes at least one suction passage for facilitating air flow communication between the surface being sanded and the suction housing 1156. Referring to FIG. 7, in the present example, the back-up apparatus 1104 includes a plurality of plate suction apertures 1178 formed in the back-up plate 1112. Referring also to FIG. 9, the plate suction apertures 1178 can be positioned so that they are within the perimeter of the suction housing sidewall 1160 (e.g. located radially inward from the housing sidewall 1160), and are in fluid communication with the suction housing inlet 1164. In the illustrated example, the back-up plate 1112 includes six plate suction apertures 1178. Optionally, the back-up plate 1112 can include a different number of plate suction apertures 1178, including between one and six suction apertures, and more than six suction apertures (for example 8, 10 or 11 suction apertures). The number of plate suction apertures can be selected based on a variety of factors, including, for example, size of the back-up apparatus, the type of abrasive material used, the nature of the surface being treated and the configuration of the suction housing 1156.

In contrast to the present example, in a conventional double action sanding apparatus, a conventional back-up pad may include a corresponding plurality of through-holes extending generally straight (longitudinally) through the back-up pad and aligned with the plate suction apertures. An abrasive sheet that is suitable for use with a conventional back-up pad may include a corresponding plurality of suction holes. In the conventional apparatus, before the abrasive sheet can be attached to the conventional back-up pad the plurality of suction holes in the abrasive sheet should be rotationally aligned with the through-holes in the back-up pad. Aligning the abrasive sheet in this manner can be challenging and time consuming, particularly if the suction system is active during the abrasive sheet replacement. For example, a slight rotational misalignment between the abrasive sheet and the back-up pad can result in some or all of the suction holes being aligned with a portion of the abrasive mounting face, instead of the suction holes in the back-up pad. This can inhibit the suction of debris.

Figure 8:
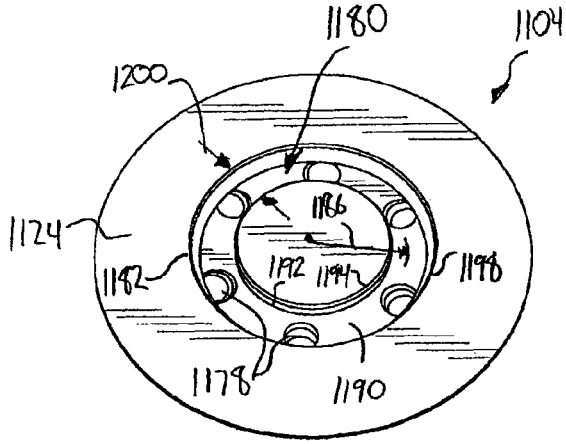
FIG. 8 is a front perspective view of the back-up apparatus of FIG. 7.

Referring also to FIG. 8, in contrast to conventional systems, the back-up pad 1114 in accordance with this aspect includes a suction channel 1180 that is in fluid communication with the plurality of plate suction apertures 1178. Preferably, the suction channel 1180 is a passage that is configured to provide fluid communication between the plate suction apertures 1178 and the abrasive sheet 1110. In the illustrated example, the suction channel 1180 is an open channel that extends through the back-up pad 1114 and is aligned with an interface suction opening 1182 in the corresponding interface layer 1124. The suction channel 1180 has a depth that is generally equal to the thickness of the back-up pad 1114. Optionally, at least a portion of the suction channel 1180 can be formed in, and/or extend into the back-up plate 1112.

The suction channel 1180 is an open channel that opens to the second pad face 1122, and the interface suction opening 1182 in the overlying interface layer 1124. While illustrated as a generally annular channel, the size and shape of the suction channel 1180 can be selected based on the configuration of the plate suction apertures 1178 and the suction holes 1184 in the abrasive sheet 1110. Preferably, the shape of the suction channel 1180 is generally symmetrical in the lateral or radial direction, so that a portion of the channel 1180 can overlie suction holes in the abrasive sheet 1110 in a variety of relative rotational positions between the abrasive sheet 1110 and the back-up apparatus 1104.

In the illustrated example, the suction channel 1180 is positioned so that it aligns with the suction holes in a multi-hole abrasive sheet 1110. This may allow the back-up pad 1114 to be used with existing multi-hole abrasive sheets (for example sheets intended for use with conventional, through-hole back-up pads). Alternatively, the pattern of holes in the abrasive sheet 1110 and the suction channel 1180 may be selected in any mutually compatible configuration, which is different than the configuration of conventional multi-hole abrasive sheets.

Preferably, any layers positioned between the back-up pad 1114 and the abrasive sheet 1110 will include an opening that generally corresponds to the shape of the suction channel 1180. Providing openings in such layers may facilitate the desired suction air flow communication between the abrasive sheet 1110 and the suction housing 1156. For example, in the illustrated example, the interface layer 1124 used in combination with the back-up pad 1114 includes a corresponding suction opening 1182 that is sized and shaped to generally match the open face of the open suction channel 1180. In the illustrated example, the suction opening 1182 in the interface layer 1124 is a generally annular or ring-like opening, concentric with the central axis 1154.

The suction channel 1180 may have any shape that is suitable for use with the suction openings in a corresponding abrasive sheet. Preferably, the suction channel 1180 is shaped so that it extends generally continuously around the second pad face 1122 at a radial distance 1186 from the central axis 1152 that coincides with the radial spacing 1188 of the suction holes 1184 in the abrasive sheet 1110. In this configuration, the plurality of suction holes 1184 in the abrasive sheet 1110 may be registered with the suction channel 1180 regardless of the rotational position of the abrasive sheet 1110 to the back-up pad 1114. This may help ensure that each suction hole 1186 in the abrasive sheet 1110 overlies the channel 1180 and is in fluid communication with the suction apertures 1178 in the backing plate 1112, which may help facilitate debris removal. This may also lessen the likelihood that one or more of the suction holes 1186 in the abrasive sheet 1110 will be blocked by or overlap the abrasive mounting face 1108.

In the illustrated example, the suction channel comprises 1180 a channel endwall 1190 disposed between the abrasive mounting face 1108 and the first pad face 1120, a first or inner channel sidewall 1192 extending from the channel endwall 1190 to a first channel edge 1194 on the second pad face 1122 and a second or outer channel sidewall 1196 extending from the channel endwall 1190 to a second channel edge 1198 on the second pad face. Alternatively, the endwall of the channel 1180 may be disposed longitudinally behind the first pad face, for example within the back-up plate 1112 (i.e. whereby the first pad face is longitudinally intermediate the endwall 1190 and the abrasive mounting face 1108).

In the illustrated example the suction channel 1180 is generally U-shaped in cross section and opens toward the abrasive mounting face 1108. Alternatively, the suction channel can have another cross-sectional shape, including, for example V-shaped, C-shaped, polygonal, square and arcuate.

The first and second channel edges 1194, 1198 are separated by a channel width 1200. The channel width 1200 can be any suitable width that is compatible with the plate suction apertures 1178, the interface suction opening 1182 and the suction holes 1184 in the abrasive sheet. Preferably, the channel width 1200 is generally equal to or greater than an aperture width 1202 (FIG. 7) of the plurality of plurality of plate suction apertures 1178. This may help facilitate fluid flow from the suction channel 1180, through the plate suction apertures 1178 and into the suction housing 1156. Alternatively, the suction channel width 1200 may be less than the diameter of the plate suction apertures. The apertures width 1202 and the channel width 1200 can each be between about 1 mm and about 60 mm, and are preferably between about 8 mm and about 25 mm. Optionally, the channel width 1200 can be between about 1% and about 25% of the diameter of the back-up pad 1114, and preferably is between about 3% and about 10% of the diameter. Providing relatively wide suction channels 1180 may help improve suction, but may lead to accelerated wear of the back-up pad and/or an unwanted degree of flexing of the back-up pad. It may also allow portions of the abrasive sheet 1110 to longitudinally deform or deflect into the channel 1180 during use. Providing a relatively narrow channel 1180 may provide a different degree of suction performance, but may help extend back-up pad life and may help limit longitudinal deformation of the abrasive sheet 1110.

Optionally, the first and second channel edges 1194, 1198 can be concentric and centered about the central axis 1154.

The channel width 1200 can also be selected so that it is equal to or wider than the suction holes 1184 in the abrasive sheet 1110. The suction holes 1184 can have diameters between about 1 mm and about 60 mm, and preferably between about 8 mm and about 25 mm. This configuration may help ensure that substantially the entire cross section of each suction hole 1184 in the abrasive sheet overlies the open suction channel 1180. Optionally selecting the channel width 1200 to be larger than the suction holes 1184 may help facilitate alignment of suction holes 1184 with the channel 1180 even if the abrasive sheet 1110 is slightly laterally misaligned with the back-up pad 1114, and may facilitate air flow through the suction holes and into the suction channel.

In the illustrated example, the back-up pad 1114 is round and the suction channel 1180 is generally circular as viewed from the abrasive mounting face 1108. Alternatively, the suction channel 1180 can be of another suitable configuration that underlies some or all of the plate suction apertures 1178 and/or overlies some or all of the suction holes 1184 in the abrasive sheet 1110, including, for example, rectangular, oval, and polygonal.

Optionally, the suction channel 1180 can be in simultaneous air flow communication with all of the plate suction apertures 1178 and all of the suction holes 1184. Preferably, the suction channel 1180 comprises a continuous, closed loop channel that is generally free from obstructions. This may facilitate air flow communication with all of the apertures 1178 and holes 1184. This configuration may help facilitate air flow within the channel 1180. Facilitating air flow within the channel 1180 may help ensure a generally equal distribution of suction amongst the suction holes 1184. A circular configuration may also help ensure that the suction holes 1184 will be aligned with the open face of the channel 1180 in any rotational position of the abrasive sheet 1110.

Alternatively, the suction channel 1180 may include two or more separate suction channels, separated by a dividing wall or other obstacle. In such a configuration, each suction channel may be in fluid communication with only a portion of the plate suction apertures 1178 and suction holes 1184. For example, if the open channel underlies only some of the plate suction apertures 1178 and/or overlies only some of the suction holes 1184 in the abrasive sheet 1110, then 2 or more open channels may be provided.

Optionally, the suction channel 1180 can be configured so that it extends through only a portion of the back-up pad 1114. In such a configuration, the channel endwall 1190 can be positioned longitudinally intermediate the second pad face 1122 and the first pad face 1120. This configuration may help maintain the strength of the back-up pad 1114 while still allowing sufficient suction air flow.

Alternatively, referring to FIGS. 8 and 9, the suction channel 1180 can extend through the back-up pad 1114, from the abrasive mounting face 1108 to the first pad face 1120. In this configuration the channel endwall 1190 can be provided by a portion of the back-up plate 1112, for example a portion of the pad attachment face 1118 or internal portion of the back-up plate 1112.

Optionally, the number of plate suction apertures 1178 can be different than the number of suction holes 1184 in the abrasive sheet 1110. For example, the suction channel 1180 may be in fluid communication with eight suction holes 1184 in an abrasive sheet 1110, and only four plate suction apertures 1178. Alternatively, a back-up apparatus 1104 may include more plate suction apertures 1178 than abrasive sheet suction holes 1184. This configuration may allow a single back-up apparatus 1104 to be used with a variety of differently configured abrasive sheets 1110.

Optionally, the total suction surface area of the plate suction apertures 1178 (i.e. the area in the suction flow direction) can be different than the total suction surface area of the suction holes 1184. This may be achieved, for example, by providing different numbers of apertures 1178 and holes 1184 of generally equal size, by providing an equal number of apertures 1178 and holes 1184 of different sizes and any combination thereof. Providing different suction surface areas may facilitate providing different air flow velocities at the apertures 1178 and holes 1184 for a given suction air flow rate.

The suction channel 1180 can be formed in the back-up apparatus 1104 using any suitable method, including, for example, routing, milling, machining, molding and stamping.

Optionally, a back-up pad can include more than one open suction channel. For example, a back-up pad may include two or more discrete suction channels (for example a pair of concentric suction channels disposed on different radii). In this configuration, the back-up plate may include two sets of suction plate apertures, one set in fluid communication with each suction channel. This configuration may be used with abrasive sheets having two sets of suction holes, arranged on different radii.

Back-Up Apparatus with Internal Suction Conduits

In accordance with another aspect of this specification, which may be used by itself or with any one or more other aspects of this specification, a back-up apparatus can be provided with one or more internal air suction conduits configured to connect at least one suction opening in an abrasive sheet in fluid communication with a source of suction. The internal suction conduits can extend through the interior of the back-up apparatus, and can connect suction apertures in the outer face of the back-up pad with suction apertures in the back-up plate. Optionally, the apertures in the outer face back-up pad can be radially outboard of the suction apertures in the back-up plate and the internal suction conduits can extend therebetween in a generally radial direction. If the back-up apparatus is used in rotary applications, for example grinding, it can be desirable to position the back-up pad suction apertures toward the edge of the back-up pad. This configuration may help capture dust and debris that is directed toward the edge of the spinning back-up apparatus.

In a particularly preferred embodiment, an internal channel is utilized in combination with one or more open channels. Providing internal suction conduits may facilitate suction of debris through the back-up apparatus.

In some instances, it may be desirable to use a common suction apparatus in combination with multiple, differently sized and/or configured back-up apparatuses. In such instances, it may be desirable to configure the back-up apparatuses to have their suction outlets (e.g. plate suction apertures) in a generally similar, or generally the same configuration that is compatible with the configuration of the suction apparatus inlet. Internal suction conduits that extend in the generally radial direction may be used to fluidly connect a variety of differently sized and positioned back-up pad suction apertures (for example apertures that are radially outboard the sidewalls of the suction housing) to plate suction apertures that are positioned in a desired, standardized configuration (for example radially inboard of the suction housing sidewall).

Optionally, the back-up apparatus can also include an internal suction plenum that is in airflow communication with some or all of the internal suction conduits. The suction plenum can also be in air flow communication with the back-up pad suction apertures and back-up plate suction apertures. Providing a suction plenum may help equalize the suction in each of the internal conduits.

Figure 10:
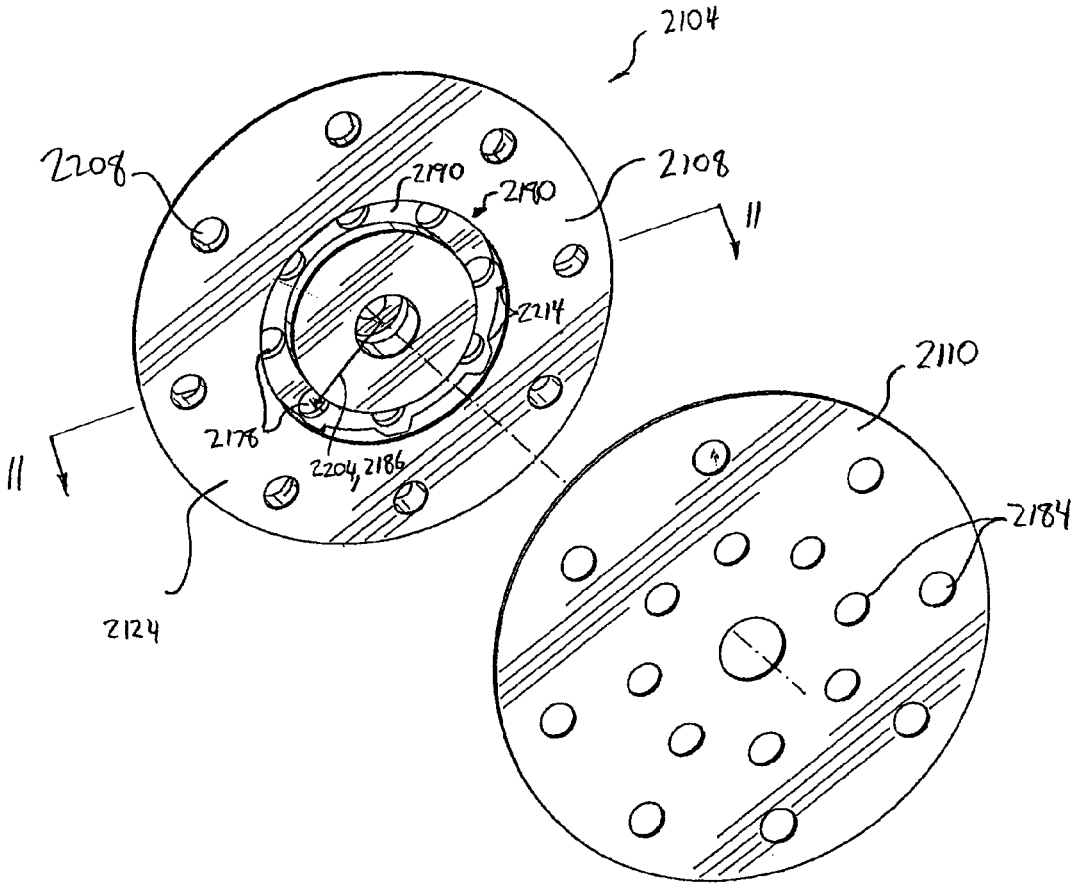
FIG. 10 is a partially exploded perspective view of another example of a back-up apparatus and an abrasive sheet.
Figure 11:
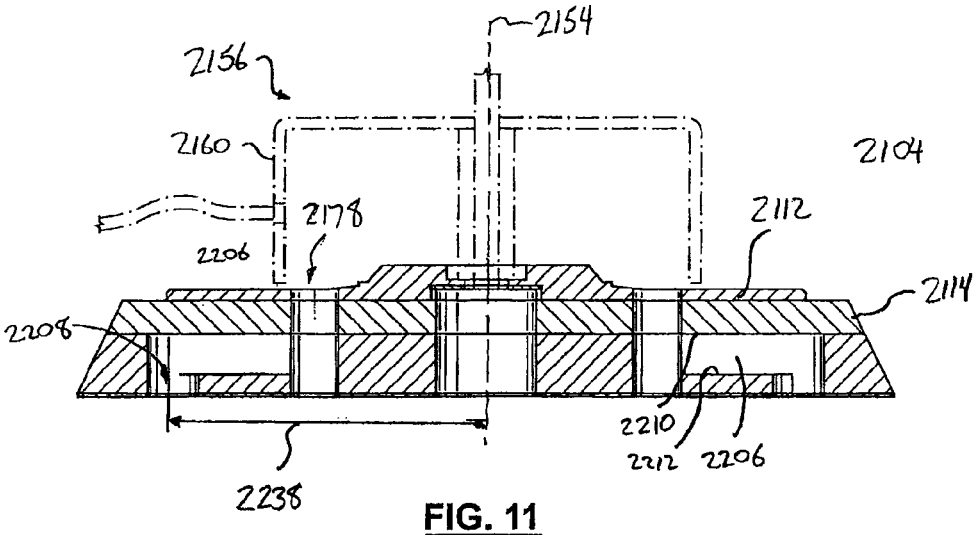
FIG. 11 is a section view taken along line 11-11 in FIG. 10.

Referring to FIGS. 10 and 11 a back-up apparatus 2104 includes a back-up plate 2112, a back-up pad 2114 and an interface layer 2124. The back-up apparatus 2104 may be generally similar to the back-up apparatuses 104, 1104, and like features are illustrated using like reference numerals starting at 2100. The back-up apparatus 2104 may have a larger diameter than the back-up apparatus 1104.

In this example, the back-up plate 2112 includes a plurality of plate suction apertures 2178. The plate suction apertures 2178 are positioned about the central axis 2154, at a radial distance 2204. The radial distance 2204 can be set so that the plate suction apertures 2178 are radially inboard of the housing sidewall 2160 (shown in phantom in FIG. 11) whereby the plate suction apertures 2178 are in air flow communication with the suction housing inlet.

The back-up pad 2114 includes a circular open suction channel 2180 open to the abrasive mounting face 2108. The suction channel 2180 is located toward the centre of the back-up pad 2104.

In the illustrated example, suction channel 2180 is radially inboard of the suction housing sidewall 2160. Alternatively, the suction channel can be positioned radially outboard of the suction housing sidewall 2160 and can be connected to the back-up plate suction apertures 2178 using suction conduits, for example, as described below. Positioning the suction channel outside the perimeter of the suction housing 2156 can help facilitate providing suction toward the periphery of the back-up pad 2114, while using a relatively smaller (radially) suction housing 2156.

In the example illustrated, a plurality of interior suction conduits 2206 are provided in the back-up pad 2114 to provide fluid communication between the plate suction apertures 2178, disposed within perimeter of the housing sidewall 2160, and a plurality of pad suction apertures 2208. The pad suction apertures 2208 can be located toward the edge of the back-up apparatus 1104 (which may help improve suction performance) and may be disposed outside the perimeter of the sidewall 2160.

The suction conduits 2206 are generally enclosed passageways extending within the back-up apparatus. In the illustrated embodiment, the conduits 2206 have a generally rectangular cross section with a first conduit endwall 2210, an opposed second conduit endwall 2212 and opposed conduit sidewalls 2214 extending therebetween. Alternatively, the suction conduits 2206 may have any other suitable cross section (for example a circular conduit) and may have a different number of walls. The cross sectional area of the conduits (taken in the direction of suction air flow) can be selected based on the desired suction air flow, the performance of the suction source, the number of conduits in the back-up apparatus, the size of the back-up pad and other factors. The cross-sectional area of each conduit can be between about 1 mm2 and about 500 mm2, and preferably is between about 10 mm2 and about 100 mm2.

The suction conduits 2206 can extend in the generally radial direction, for example in a direction that is parallel to the plane containing the abrasive mounting face 2108. In the illustrated example, the internal suction conduits 2206 extend radially across the housing sidewall 2160.

Optionally, the conduits 2206 can be generally straight or linear conduits extending transversely through the back-up pad in the radial direction. Alternatively, the suction conduits 2206 can be arranged at an angle, relative to the radial direction, or may be curved (for example within a plane parallel to the abrasive mounting face 2180, in a plane that is not parallel to the abrasive mounting face 2180 and any combination thereof.

Providing the suction conduits at an angle relative to the radial direction may allow the movement of the back-up apparatus to help urge sanding debris along the suction conduits 2206, to the plate suction apertures 2178.

Suction conduits arranged at an angle relative to the radial direction, but still fluidly connecting a suction inlet (e.g. for example a pad suction aperture 2208) at a first radial distance with a suction outlet (e.g. plate suction apertures 2178) at a second, smaller radial distance can be considered to be extending at least partially in the generally radial direction.

Optionally, the number of suction conduits 2206 can correspond to the number of plate suction apertures 2178. Alternatively, the number of suction conduits 2206 can be different than the number of plate suction apertures 2178.

Optionally, the back-up apparatus can be configured to include only a discrete plurality of pad suction apertures, instead of also including an open suction channel. In such a configuration, each of the pad suction apertures can be fluidly connected to the suction source using the internal suction conduits.

In some applications, forming a continuous, open suction channel in the back-up pad may be undesirable. For example, in rotary sanding applications, a peripheral suction channel may weaken the structural integrity of the back-up pad and may contribute to accelerated or premature back-up pad replacement or failure. In such applications, it may be desirable to remove a relatively smaller amount of material from the periphery of the back-up pad, while still providing suction inlet apertures toward the edges of the back-up pad. The amount of material required to provide a desired level of back-up pad integrity can depend on, for example, the type of material used, and the expected operating conditions of the back-up pad. In such applications, it can be advantageous to provide an internal suction passage that can connect the plurality of suction apertures to a common suction source. Preferably, the internal suction passage can include a common channel or plenum that is in fluid communication with multiple suction apertures. This may help maintain a generally equal level of suction at each suction aperture.

Figure 12:
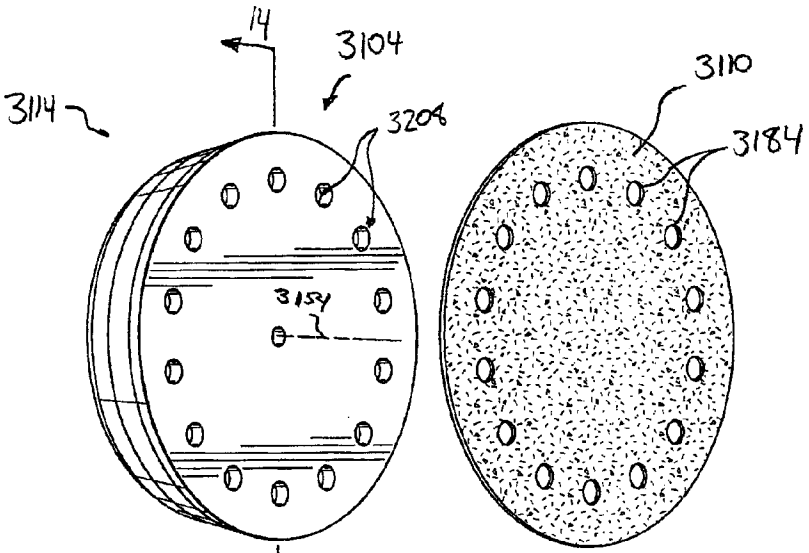
FIG. 12 is a partially exploded perspective view of another example of a back-up apparatus and an abrasive sheet.
Figure 13:
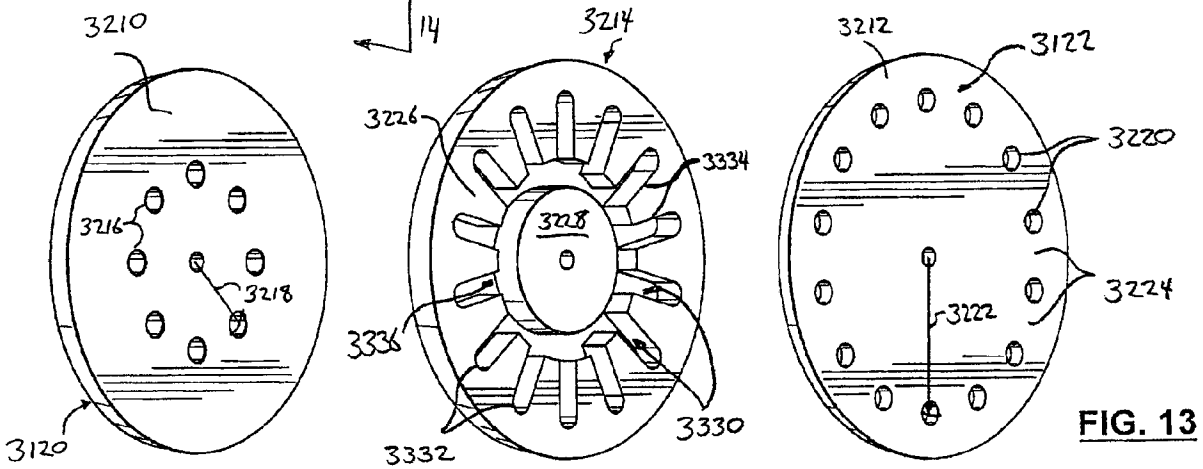
FIG. 13 is an exploded view of the back-up pad of FIG. 12.
Figure 14:
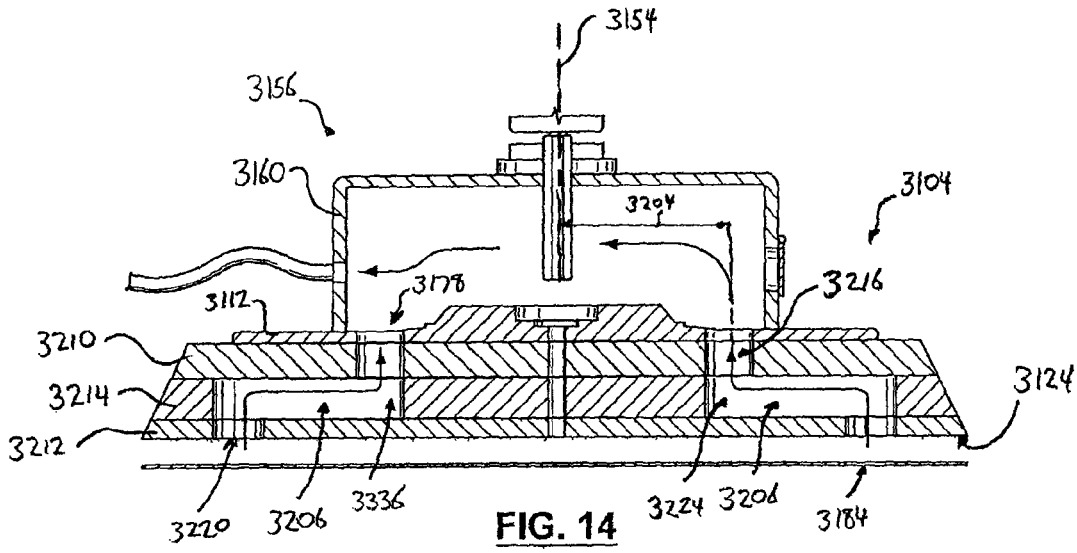
FIG. 14 is a section view taken along line 14-14 in FIG. 12.

Referring to FIGS. 12-14, another example of a back-up apparatus 3104 includes a back-up plate 3112, a back-up pad 3114, interface layer 3124 (optionally adhesive or mechanical attachment means). The back-up apparatus 3104 may be generally similar to back-up apparatuses 104, 1104, 2104 and like elements are identified using like reference numerals starting at 3100. The back-up apparatus 3104 is rotatable about the central axis 3154 and the back-up apparatus 3104 includes a suction passage that extends from suction inlets on the back-up pad, to the plate suction apertures and into the suction housing.

In this example, the back-up plate 3112 includes a plurality of plate suction apertures 3178 extending through the back-up plate 3112. The plate suction apertures 3178 are located at a first radial distance 3204 from the central axis 3154. The first radial distance 3204 can be selected so that plate suction apertures 3178 are positioned within the suction housing 3156 (e.g. radially inboard of the housing sidewall 3160—shown in phantom). For example, the first radial distance can be between about 5 mm and about 500 mm, and preferably can be between about 10 mm and about 100 mm. The suction housing can be of any compatible size so that the suction housing sidewall surrounds the plate suction apertures.

Optionally, the radial position of the plate suction apertures 3178 can be about the same for a variety of back-up apparatus 3104 sizes. For example, the radial distance 3204 can be the same for 4 inch, 6 inch and 8 inch diameter back-up apparatuses 3104. In this configuration, the same suction housing 3156 can be used in combination with a variety of back-up apparatus diameters. This may allow a single suction housing 3156 to be used with a variety of different back-up apparatus 3104.

In the illustrated example, the back-up pad 3114 is a multi-layer back-up pad having an inner layer 3210 (adjacent the back-up plate 3112 and comprising the first pad face 3120), an outer layer 3212 (adjacent the interface layer 3214 and comprising the second pad face 3122) and an intermediate layer 3214 positioned therebetween. The layers are permanently affixed to each other using a suitable adhesive. The layers 3210, 3212 and 3214 can be made of the same, or different materials.

The inner layer 3210 comprises a plurality of inner pad suction apertures 3216 that can be registered with the plate suction apertures 3178. The inner layer 3210 can be permanently and non-rotatably bonded to the back-up plate 3112. This configuration may help ensure the inner pad suction apertures 3216 remain registered with the plate suction apertures 3178 during use.

The inner pad suction apertures 3216 can be arranged in any pattern that compliments the arrangement of the plate suction apertures 3178. In the illustrated example, the inner pad suction apertures 3216 are positioned along a constant circumference, and at a radial distance 3218 from the central axis 3154. The radial distance 3218 is generally equal to the radial distance 3204 of the plate suction apertures 3178. Alternatively, the apertures 3216 and 3178 need not be provided on a constant circumference. Because the back-up pad 3114 can be attached to the back-up plate 3112 during manufacture of the back-up apparatus 3104, its rotational alignment can be carefully, and a user need not work The outer layer 3212 includes a plurality of outer pad suction apertures 3220. In the illustrated example, the outer pad suction apertures 3220 are positioned around the periphery of the outer layer 3212, at a radial distance 3222 from the central axis 3154. The radial distance 3222 is greater than the radial distance 3218. Optionally, the radial distance 3222 can be selected so that the plurality of outer pad suction apertures 3220 are radially outboard of the suction housing sidewall 3160. In this example, the plurality of outer pad suction apertures 3220 form the back-up pad suction inlets. Alternatively, the outer pad suction apertures 3220 can be positioned in a different pattern and at a different location on the outer layer 3212.

A plurality of connecting webs 3224 are provided between adjacent outer pad suction apertures 3220. The number and spacing of outer layer suction apertures 3220 can be selected to provide a desired number and size of connecting webs 3224. This may help facilitate providing a back-up pad 3114 with suction and sufficient pad integrity. The number and spacing of the pad suction apertures 3220 can also be selected to help minimize debris escaping from the edge of the back-up apparatus 3104. For example, spacing the pad suction apertures 3220 relatively far apart from each other may help increase the strength of the back-up pad 3114, but may allow some dust or debris to escape by passing between adjacent pad suction apertures 3220. Alternatively, placing the pad suction apertures 3220 relatively close together may help prevent debris from escaping between the pad suction apertures 3220, but may weaken the back-up pad 3114. For a given surface treating operation, the configuration of the pad suction apertures 3220 can be selected to appropriately balance suction coverage and back-up pad strength (whether used alone or in combination with other suction passages, channels and conduits).

Optionally, the number of outer layer suction apertures 3220 can be different than the number of inner layer suction apertures 3216. For example, an 8 inch back-up pad may include 14 outer layer suction apertures and 8 inner layer suction apertures.

The intermediate layer 3214 can include a plurality of internal suction conduits 3206 fluidly connecting the outer pad suction apertures 3220 with the inner pad suction apertures 3216.

In the illustrated example, the plurality of internal suction conduits 3206 are fluidly connected to an internal plenum 3224, which is in fluid communication with the inner pad suction apertures 3216.

In the illustrated example, the intermediate layer 3214 is a two piece layer including a generally annular ring member 3226 surrounding a generally circular central member 3228. Alternatively, the intermediate layer 3214 can be a unitary member or can include a different number of discrete members.

In the illustrated example the ring member 2226 includes a plurality of radial slots 3330, generally extending in a direction parallel to the plane containing the abrasive mounting face 3108. The distal ends 3332 of the slots 3330 are registered with and in air flow communication with the outer pad suction apertures 3220. When sandwiched between the inner and outer pad layers 3210, 3212, the sidewalls 3334 of the slots 3330 and portions of the inner and outer pad layers 3210, 3212 co-operate to provide the sidewalls and endwalls that define the internal suction conduits 3206. Also when sandwiched between the inner and outer pad layers 3210, 3212, the generally annular gap between the ring member 3226 and the central member 3228 defines a generally annular internal plenum 3224, which is open to the proximal ends 3336 of the internal suction channels 3206.

The central member 3228 may help provide strength to the back-up pad 3114, for example to help resist the axial compressive forces applied by a central safety fastener, as explained below. Adjusting the size of the central member 3228 may adjust the volume of the internal plenum 3206.

In this example, air and debris entering the outer pad suction apertures 3220 can travel through the plurality of internal conduits 3206 and flow into the internal plenum 3224. Air and debris in the internal plenum 3224 can then be sucked into the suction housing 3156, via the inner pad suction apertures 3216 and plate suction apertures 3178, for removal.

Alternatively, for example in embodiments where the number of outer pad suction apertures equals the number of inner pad suction apertures, corresponding pairs of pad apertures can be directly connected using dedicated suction conduits, without the need for an internal plenum.

The internal suction conduits 3206 and internal plenum 3224 can have any suitable configuration, and need not be limited to radial conduits coupled to an annular plenum.

Optionally, a back-up pad can include any suitable combination of suction channels, suction conduits and suction apertures. For example, referring again to FIGS. 10 and 11, the back-up pad 2114 includes a plurality of pad suction apertures 2208 positioned at a first radial distance 2238 around the periphery of the back-up pad 2114, and an open suction channel 2180 positioned inboard of the plurality suction apertures 2208, at a second radial distance 2186.

In this configuration, the plurality of suction apertures 2208 located around the periphery of the back-up pad 2114 are not through-holes. Instead, the plurality of suction apertures 2208 are fluidly connected to the open suction channel 2180 (and therefore the plate suction apertures 2178) by the plurality of internal suction conduits 2206. In the illustrated example, the number of pad suction apertures 2208 is the same as the number of plate suction apertures 2178.

Referring to FIG. 10, an abrasive sheet 2110 suitable for use with the back-up pad 2114 includes two sets of suction holes 2184. One set of suction holes is arranged to align with the plurality of pad suction apertures 2208. The other set of suction holes is arranged to overlie the open suction channel 2180.

In this example, the back-up pad 2114 suction inlet includes a combination of the plurality of suction apertures 2208 and the open suction channel 2180.

Configuration of a Safety Fastener

In accordance with another aspect of this specification, which may be used by itself or with any one or more other aspects of this specification, a safety fastener can be used to secure an abrasive sheet to a surface treatment apparatus. Under certain operating conditions, for example high temperatures and/or high friction between the abrasive sheet and the surface being treated, there can be a risk that the abrasive sheet can separate from the back-up pad. For example, the primary attachment mechanism used to hold the abrasive sheet to the back-up apparatus, for example hook and loop fasteners and some conventional adhesives, can weaken over time, reducing the strength of the bond with the abrasive sheet. In some applications, it can be advantageous to provide a secondary, safety fastening mechanism to secure the abrasive sheet to the back-up pad. The safety fastening mechanism can be configured to keep the abrasive sheet attached to the surface treating apparatus in the event of a primary attachment mechanism failure.

Preferably, the safety fastening mechanism is releasable to facilitate changing and replacement of the abrasive sheets, and is re-usable. The back-up apparatus can be configured to receive the safety fastening mechanism.

Figure 15:
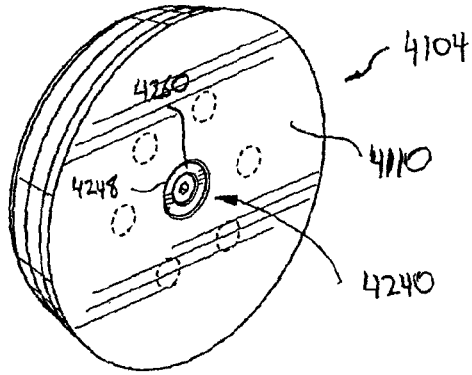
FIG. 15 is a perspective view of another example of a back-up apparatus and an abrasive sheet.
Figure 16:
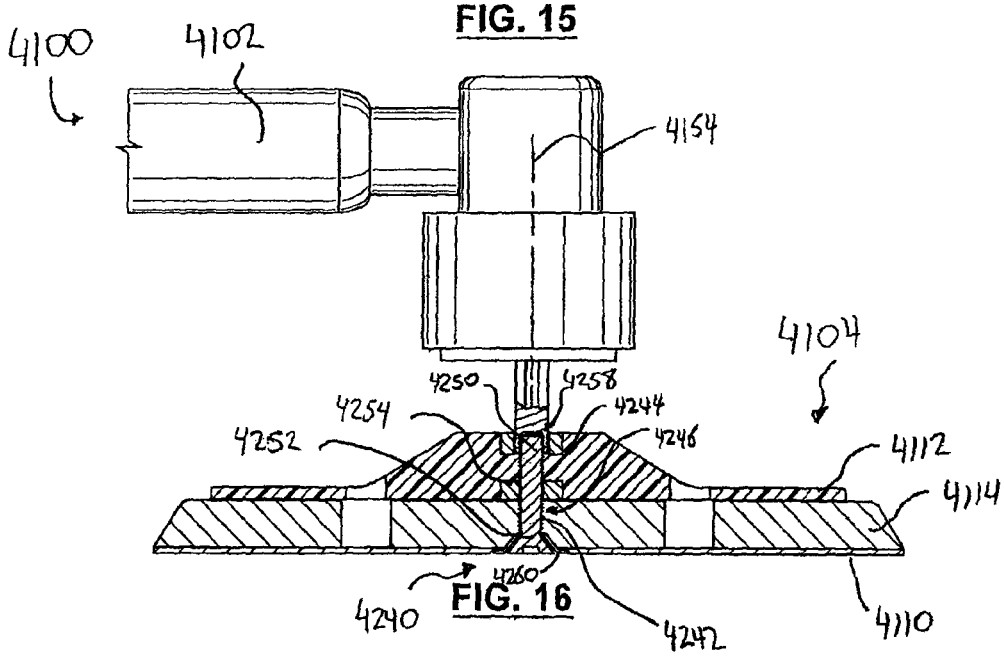
FIG. 16 is a partial section view of another example of a sanding apparatus.

Referring to FIGS. 15 and 16, a rotary sanding apparatus 4100 includes rotary driving apparatus 4102 and a rotatable back-up apparatus 4104. The sanding apparatus 4100 may be generally similar to the sanding apparatuses 100, 1100, 2100 and 3100, and like features are illustrated using like reference numerals starting at 4100. The back-up apparatus 4104 is rotatable about a central axis 4154.

Under some circumstances, an abrasive sheet can unintentionally become separated from a back-up apparatus while the sanding apparatus is in use, for example due to a failure of the bond between the abrasive sheet and the abrasive mounting face. Such separations may cause damage to the surface being sanded, and may pose a safety risk to users. For example, if the back-up apparatus is operating at a relatively high speed (for example between about 2500-15000 rpm), an abrasive sheet that is separated from the back-up apparatus may fly off of the sanding apparatus, possibly striking a user or bystander. It may be desirable to use a safety fastening mechanism to help prevent separation of the abrasive sheet 4110 from the sanding apparatus 4100.

Referring again to FIGS. 15 and 16, the sanding apparatus 4100 includes a safety fastener 4240. The safety fastener 4240 provides an additional means for securing the abrasive sheet 4110 to the sanding apparatus 4100, and may serve as a secondary or back-up attachment means in the event that the bond between the abrasive sheet 4110 and the abrasive mounting face 4108 should fail.

In the illustrated embodiment, the safety fastener includes 4240 a safety bolt 4242 that extends through the abrasive sheet 4110 and into the back-up apparatus 4104. Alternatively, any suitable fastener can be used, including, for example a screw, a locking pin, and a clamping mechanism.

In this example, the back-up plate 4112 includes a central bore 4244 for receiving the safety bolt 4242. The back-up pad 4114 includes central opening 4246 that is in registration with the central bore 4244 on the back-up plate 4112. The safety bolt 4242 is releasably securable within the central bore 4244 and is configured to extend through both the central opening 4246 in the back-up pad 4114 and a central opening 4248 in the abrasive sheet 4110. When the safety bolt 4242 is secured in the central bore 4244, the abrasive sheet 4110 is secured to the back-up apparatus 4104. The safety bolt 4242 includes an attachment portion 4250 (for example the shaft of the bolt) and a retaining portion 2452 (for example the head of the bolt). The bolt 4242 and bore 4244 can have any complimentary cross-sectional shapes. It will be appreciated that if the central bore is not recessed, then the safety fastener may not need to extend through the back-up pad.

In the illustrated example, the central bore 4244 is internally threaded and the safety bolt can be screwed into the bore 4244. This configuration may help facilitate the insertion of the safety bolt 4242 to secure an abrasive sheet 4110, and the subsequent removal of the safety bolt 4242 to facilitate replacement of the abrasive sheet 4110. Alternatively, the safety fastener can be secured to the apparatus 4100 using another suitable method, including, for example, locking pins, detent members, an interference fit and magnetic fasteners.

Optionally, the threads in the central bore can be integral with the back-up plate 4112, or secured thereto such as by welding, an adhesive, mechanical fasteners or the like or provided by a separate anchor member that is provided in the back-up apparatus 4104.

In the illustrated example, the back-up plate is a molded plastic plate that includes a metal anchor member 4254, which is molded into the plate 4112. The anchor member 4254 is a metal nut having threads that are compatible with the threads on the safety bolt 4242. Providing a metal anchor member 4254 in the back-up plate 4112 may help increase the strength of the threads in the central bore 4244 (as opposed to molded plastic threads).

Optionally, the central bore 4244 may be a through hole in the back-up plate 4114. In this configuration, the central bore 4244 may provide access to the drive spindle 4256 on the driving apparatus 4102. Optionally, the drive spindle 4256 can include a spindle bore 4258 that is sized to receive the safety bolt 4242. Preferably, the spindle bore 4258 is internally threaded, and the safety bolt 4242 can be threaded into the spindle bore 4258. Threading the safety bolt 4242 into the spindle bore 4258 may allow the safety bolt 4258 to fasten the abrasive sheet 4110 to the driving apparatus 4102. Optionally, the safety bolt 4258 can be secured only to the spindle bore 4258, and need not engage the central bore 4244. For example, the central bore 4244 can be a smooth through hole and the safety bolt 4258 (or other type of fastener) can extend freely thought the central bore 4244 and be retained by engagement (threaded or otherwise) with the spindle bore 4258. This may still help prevent separation of the abrasive sheet 4110 from the back-up apparatus 4104.

An abrasive sheet 4110 that is compatible with the safety bolt 4242 can have a central fastener aperture 4248 for receiving the safety bolt 4242. The abrasive sheet 4110 includes both an attachment face for coupling the abrasive sheet 4110 to the abrasive mounting face 4108 of the back-up pad 4114 (as described above), and an attachment aperture 4248 for receiving a safety fastener 4240 for coupling the abrasive sheet 4110 directly to the back-up plate 4112 and/or the driving apparatus 4102.

The central fastener aperture 4248 can be at least partially registered with the central bore 4244 when the abrasive sheet 4110 is in place. Preferably, the central fastener aperture 4248 has a diameter that is smaller than the diameter of the retaining portion 4252 of the safety bolt 4242.

Optionally, the retaining portion can 4252 include a washer 4260 that is rotatable relative to the safety bolt 4242 and is non-rotatable with respect to the back-up pad as the safety bolt is installed. The washer 4260 is sized to be freely rotatable relative to the safety bolt 4242. In the illustrated example, the central opening in the washer 4260 is slightly larger than the diameter of the shank of the safety bolt 4242. When the retaining portion 4252 of the bolt 4242 is spaced apart from the abrasive sheet, the washer 4260 is free to rotate. As the bolt 4242 is tightened, the retaining portion 4252 and the washer 4260 approach the abrasive sheet 4110 until the washer 4260 makes contact with the abrasive sheet 4110. In this position, the friction between the washer 4260 and the abrasive sheet is sufficient to inhibit free rotation of the washer 4260. The bolt 4242 can continue to be tightened, as it can rotate relative to the washer 4260. As the bolt 4242 is tightened, the friction between the washer 4260 and the abrasive sheet 4110 can increase, as the retaining portion 4252 contacts and rotates relative to the outer face of the washer 4260. When the bolt 4242 is fully tightened, the compressive forces exerted by the safety bolt 4242 on the washer 4260 and abrasive sheet 4110 inhibit rotation of the washer 4260 relative to the abrasive sheet 4110 when the abrasive sheet 4110 is in use. During this mounting operation the retaining portion 4252 of the bolt 4242 need not contact the abrasive surface. Also, the washer 4260 need not rotate relative to the abrasive sheet 4110 while it is in contact with the abrasive sheet 4110.

In the absence of the washer 4260, when the safety bolt 4242 is being installed and removed (i.e. rotated relative to the abrasive sheet 4110), the underside of the head of the safety bolt 4242 would grind against the abrasive material on the abrasive sheet 4110. This grinding may wear the safety bolt 4242 and eventually lead to a failure. When the washer 4260 is provided on the safety bolt 4242, the washer can contact the abrasive material and remain stationary relative to the abrasive material as the safety bolt 4242 is tightened and loosened. When the safety bolt 4242 has been fully tightened, there is no longer relative rotation between the safety bolt 4242 and washer 4260, and both the safety bolt 4242 and the washer 4260 can move in unison with the back-up apparatus 4104.

Optionally, the back-up pad 4114 is configured such that when the fastener 4240 is fully secured within the central bore 4244, the head of the safety bolt 4242 is recessed at or below the abrasive mounting surface 4108 of the pad 4114. For example, the back-up pad 4114 may have a recess to accommodate the head of the safety bolt 4242, and/or may be sufficiently compressible such that the back-up pad 4114 can compress as the safety bolt 4242 is tightened. This configuration may help prevent the head of the safety bolt 4242 from contacting the surface being sanded.

Configuration of a Mounting Tool

In accordance with another aspect of this specification, which may be used by itself or with any one or more other aspects of this specification, a mounting tool can be used to place an abrasive sheet on a corresponding back-up apparatus. Obtaining proper radial and rotational alignment between an abrasive sheet and a back-up apparatus can be challenging when the abrasive sheet is attached by hand. It can be advantageous to properly align the abrasive sheet on the back-up apparatus. Improper radial or lateral alignment can cause imbalances and vibrations when the surface treatment apparatus is use. Improper rotational alignment can result in improper registration of the suction holes in the abrasive sheet with the suction apertures in the back-up pad, which may impede suction performance. Placing the abrasive sheet on the back-up apparatus may be particularly challenging when the suction apparatus is active, as the suction from the pad suction apertures may tend to pull the abrasive sheet against the back-up pad before it can be properly aligned.

It may be advantageous to provide a mounting tool that can be used to assist a user when attaching an abrasive sheet to a back-up pad, particularly when the abrasive sheet includes suction holes. It may be desirable to have a mounting tool that can be used when the suction apparatus is active.

For example, in instances when the back-up pad includes a plurality of discrete pad suction apertures in the abrasive mounting face (instead of or in addition to an open suction channel), it may be advantageous to use an abrasive sheet mounting tool to help facilitate placement of an abrasive sheet on the back-up pad. Alternatively, if the back-up pad includes an open suction channel, the mounting tool can be configured so that it is compatible with the open suction channel.

Figure 17:
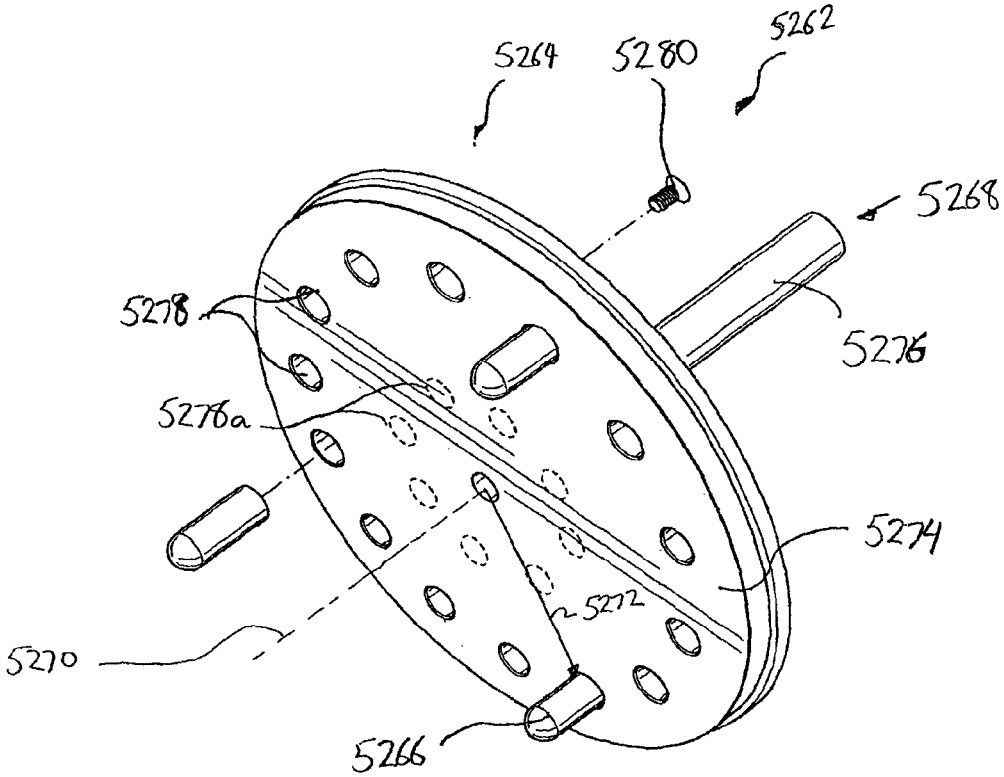
FIG. 17 is a perspective view of an abrasive sheet mounting tool.
Figure 18:
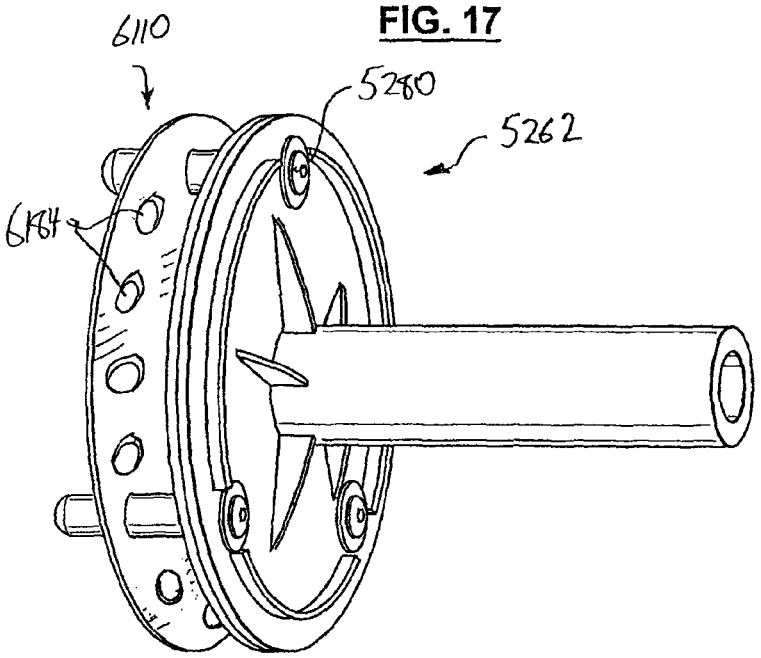
FIG. 18 is a rear perspective view of the abrasive sheet mounting tool of FIG. 17.

Referring to FIGS. 17 and 18, an abrasive sheet mounting tool 5262 includes a body 5264 and a plurality of alignment pins 5266. The body 5264 includes a handle portion 5268 for allowing a user to carry and manipulate the tool 5262.

Figure 19:
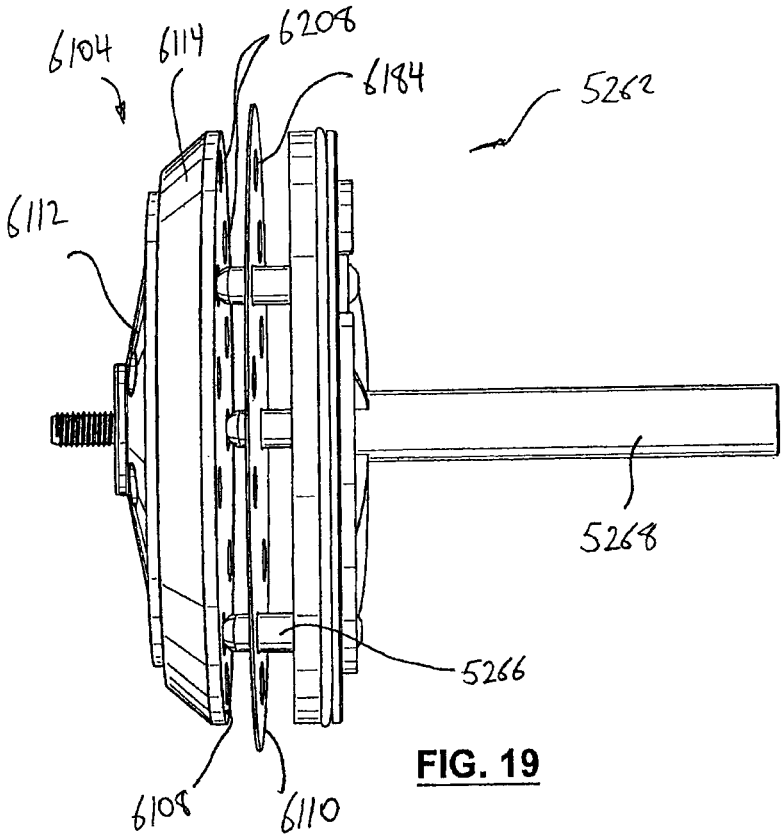
FIG. 19 is a side view of the abrasive sheet mounting tool of FIG. 17, in combination with an abrasive sheet and a back-up apparatus.

Referring also to FIG. 19, as exemplified, the mounting tool 5262 is configured to be used in combination with a back-up apparatus 6104 having a plurality of pad suction apertures 6208 and an abrasive sheet 6110 having a corresponding plurality of suction holes 6184. The pad suction apertures 6208 and suction holes 6184 in the abrasive sheet 6110 are arranged in a complimentary pattern so that the suction holes 6184 can be registered with the pad suction apertures 6208, as explained in detail herein.

The plurality of alignment pins 5266 extend from the body 5264. In the illustrated example the mounting tool 5262 includes three alignment pins 5266. In other examples, the mounting tool 5262 may include a different number of alignment pins, including for example two, four or more alignment pins.

The mounting tool 5262 preferably has a central tool axis 5268. The alignment pins 5266 can be radially spaced apart from the tool axis by a radial distance 5272. In the illustrated example, the alignment pins 5266 are spaced and arranged in a pattern that corresponds to the pattern of suction holes 6184 and pad suction apertures 6208. In this configuration each one of the plurality of alignment pins 5266 can be aligned with a corresponding one of the plurality of suction holes 6184 in the abrasive sheet 6110 so that the abrasive sheet 6110 can be slid onto, and supported by the mounting tool 5262 (FIG. 18).

With an abrasive sheet 6110 supported on the mounting tool 5262, the user can then align the mounting pins 5266 with respective ones of the pad suction apertures 6208 (or one or more open channels), and slide at least a portion of the alignment pins 5266 into the apertures 6208 (or the open channel or channels). In this position, the abrasive sheet 6110 is both radially and rotationally aligned with the back-up pad 6114, so that the abrasive sheet 6110 is generally centred relative to the back-up pad 6114 and the suction holes 6184 in the abrasive sheet 6110 are registered with the pad suction apertures 6208 (FIG. 19).

From this aligned position, the abrasive sheet 6110 can be slid down the alignment pins 5266 (in the longitudinal direction), toward the back-up pad 6114. The abrasive sheet 6110 can then be pushed into contact with and can be coupled to the abrasive mounting face 6108. The abrasive mounting face 6108 can include any suitable fastening system, including, for example, adhesive and mechanical interface layers described herein.

Optionally, the tips of the alignment pins 5266 can be contoured (e.g., rounded). Rounding, or otherwise shaping the tips of the alignment pins 5266 may help facilitate insertion of the alignment pins 5266 into the suction holes 6184 and pad suction apertures 6208. The cross-sectional shape of the alignment pins 5266 can be any suitable shape that can fit within the suction holes 6184 and pad suction apertures 6208, including, for example, circular (as illustrated) and polygonal.

Optionally, alignment pins 5266 may be moveably mounted on the tool. For example, they may slidably mounted thereto or removably attached thereto so that the alignment pins 5266 may be moved to alternate positions. Referring again to FIG. 17, in the example illustrated, the alignment pins 5266 are removably attached. As exemplified, the mounting tool 5262 includes a generally planar pin support pad 5274 mounted on the supporting body 5264. In this configuration, the handle portion 5268 includes a rod-like handle member 5276 extending from the back of the supporting body 5264. Optionally, the planar support pad 5274 can have the same configuration as the back-up pad 5114.

The pin support pad 5274 can include a plurality of pin apertures 5278 that can be sized to receive the mounting pins 5266. Optionally, the mounting pins 5266 can be releasably received within the pin apertures 5278, so that the mounting pins 5266 can be removed from the pin apertures 5278 and re-inserted into any one of the pin apertures 5278.

The mounting pins 5266 can be held in the pin apertures 5278 by an interference fit, or by any other suitable fastening mechanism, including, for example, adhesives and mechanical fasteners. In the illustrated example, the alignment pins 5266 are held in position using screws 5280 that extend through the supporting body 5264.

Optionally, the pin support pad 5274 can be detachable from the supporting body 5264. In this configuration, the pin support pad 5264 can be replaced with a different pin support pad that is configured match a different suction hole/pad suction aperture pattern. The alignment pins 5266 can then be mounted in the new pin support pad such that they are aligned with the new suction hole pattern. This may allow the supporting body 5264 to be used in combination with a plurality of different abrasive sheet/back-up pad configurations.

Alternatively, or in addition, a single pin support pad 5274 can include a plurality of sets of mounting pin apertures 5278 (see additional apertures 5278*a* shown in phantom in FIG. 17), each set can be configured to match a given suction hole/pad suction aperture pattern. The alignment pins 5266 can be positioned in different ones of the sets of mounting pin apertures 5278, based on, for example, the specific back-up pad being used for the current job. This configuration may help facilitate mounting a variety of differently configured abrasive sheets on a corresponding plurality of back-up pads using the same pin support pad.

Figure 20:
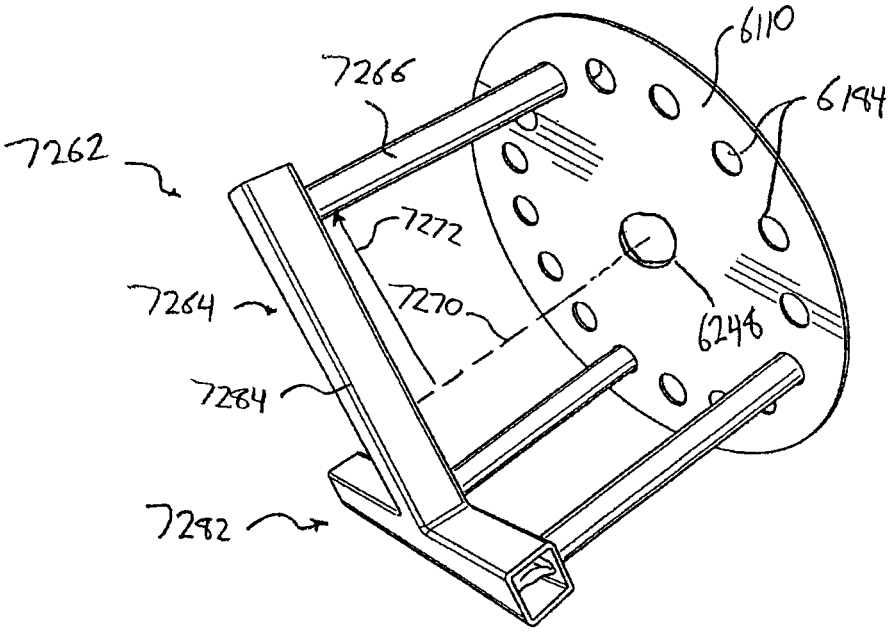
FIG. 20 is a perspective view of another example of an abrasive sheet mounting tool.
Figure 21:
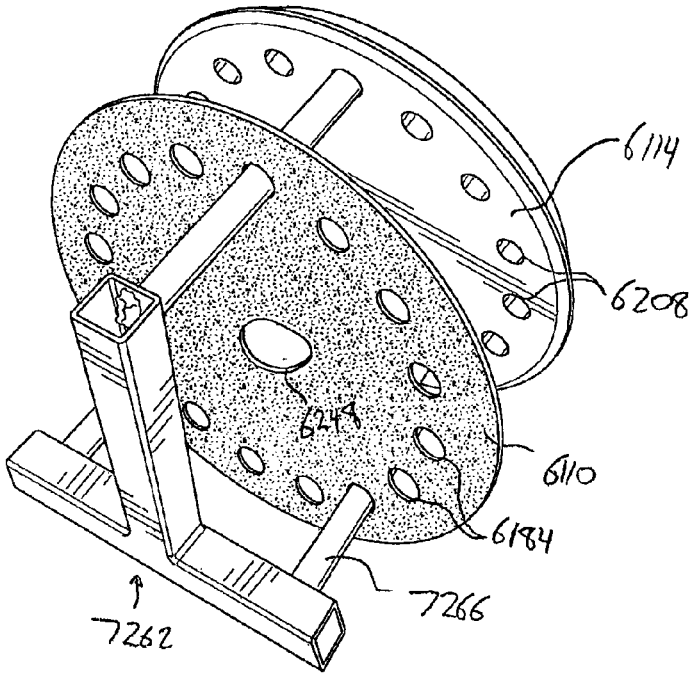
FIG. 21 is a perspective view of the abrasive sheet mounting tool of FIG. 20, in combination with an abrasive sheet and a back-up apparatus.
Figure 22:
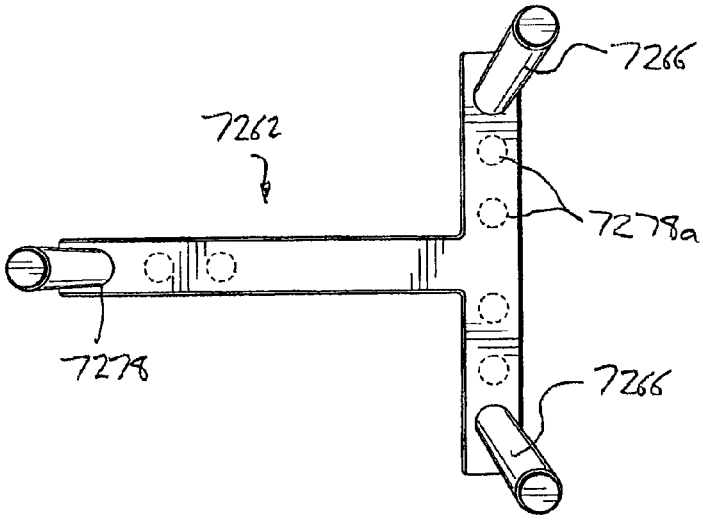
FIG. 22 is a plan view of the of the abrasive sheet mounting tool of FIG. 20.

Referring to FIGS. 20-22, another example of a pin mounting tool 7262 includes three alignment pins 7266 mounted on a supporting body 7264. In this configuration the supporting body 7264 includes a generally T-shaped frame 7282, and the handle portion 7268 includes a grippable region 7284 on the frame.

The mounting tool 7262 does not include a pin mounting pad, or an axially extending handle member projecting from the supporting body. In this example, the frame 7282 is configured so that the alignment pins 7266 are located an appropriate radial distance 7272 from the central tool axis 7270, so that the alignment pins 7266 can be aligned with the suction holes 6184 and pad suction apertures 6208 in a given abrasive sheet 6110 and back-up pad 6114, respectively.

The mounting tool 7262 can also be re-configurable to accommodate different suction hole patterns. For example, frame 7282 can include multiple alignment pin attachment locations 7278, 7278*a* so that the position of the alignment pins 7266 can be changed as needed.

The mounting tool 7262 may also be used to mount abrasive sheets that are secured to a back-up apparatus using a central locking fastener. Examples of such abrasive sheets include fiber discs and a heavy 24 or 36 grit resin cloth sheets. These abrasive sheets can include a central aperture 6248 that can be registered with the spindle of a driving apparatus, such as an electric grinder. A locking nut (for example a nut similar to nut 10290*a* described below) can be inserted into the aperture 6248 and threaded onto the spindle. When mounting the abrasive sheet 6110, the spindle can be locked so it cannot turn freely. The heavy abrasive sheets can be slid onto the alignment pins 7266 and the pins 7266 can be placed into corresponding pad suction apertures (or into a suitable open suction channel). This may help align the suction holes in the abrasive sheet with the pad suction apertures (or suction channel), and may help register the central aperture 6248 with the spindle.

Mounting tool 7262 does not include a pin support pad. The absence of a pin support pad extending laterally between the alignment pins 7266 may help provide sufficient working space for a user to access the central aperture 6248 while the abrasive sheet 6110 is supported on the mounting tool 7262, for example to insert and tighten a locking nut to secure the abrasive sheet to the back-up apparatus. Optionally, the mounting pins 7266 can be left in the pad suction apertures (or suction channel) while the fastening nut is installed. Optionally, the alignment pins 7266 can be used to help impede rotation of the abrasive sheet relative to the back-up apparatus while the locking nut is being tightened, or optionally loosened. This may help keep all the suction holes lined up with the pad suction apertures (or suction channel) while tightening nut and securing the abrasive sheet to the back-up apparatus. If the locking nut has been tightened too much, for example if it tightens during use, the spindle can again be locked and the alignment pins can be re-inserted in the pad suction apertures to help unscrew the locking nut.

The mounting tools and alignment pins can be made from any suitable materials, including, for example plastic and metal. The mounting tools can be used with any suitable type of back-up pad, including, for example, rotary back-up pads and double-action back-up pads.

Configuration of a Back-Up Plate

In accordance with another aspect of this specification, which may be used by itself or with any one or more other aspects of this specification, a back-up apparatus can include a back-up plate that is generally planar. Optionally, the back-up plate can be free from integrated hardware. Conventional back-up plates tend to have 3D, or non-planar configurations, and are formed from injection molded plastic. Mounting hardware is often molding into the part. The rear surfaces of conventional back-up plates can vary from plate to plate, and between sizes of back-up apparatus. The differences in the configuration of the back-up plates can make it difficult to provide an apparatus that is compatible with multiple styles and sizes of back-up apparatus, optionally for different purposes.

Injection molding back-up plates can be relatively expensive. Design changes to molded back-up plates can require changes to the corresponding molds, dies etc. Forming back-up plates from a planar sheet of material can be relatively lower cost than injection molding, and can allow for increased design flexibility.

In the examples describe previously, the back-up plate is generally more rigid than the back-up pad. Optionally, the back-up plate can be formed from molded plastic. In such a configuration, the back-up plate may have a curved, three-dimensional rear face (facing away from the back-up pad).

Alternatively, according to this aspect, the back-up plate can be a generally planar member, having a generally planar, or two-dimensional, rear face. Providing a planar rear face may help reduce the amount of material required to form the back-up plate.

Providing a planar rear face may also help standardize the axial dimensions/configurations of different sized back-up plates. Standardizing the size and shape of the rear face may help facilitate the use of the same auxiliary equipment, such as the suction housing, with a variety of back-up plates of different sizes. This configuration may allow a user to quickly change the back-up apparatus on a sanding apparatus (for example from an eight inch grinding abrasive to a six inch sanding abrasive) without having to adjust or reconfigure the suction housing, and optionally other equipment.

Planar back-up plates may also be easier and/or less expensive to manufacture than an analogous mold plastic back-up plate. The material used in the planar back-up plate can be selected that it is more warp resistant than conventional molded back-up plates. The back-up plate can be formed in any suitable shape for use with a variety of surface treating apparatuses, and need not be limited to circular or disc-like plates.

Figure 23:
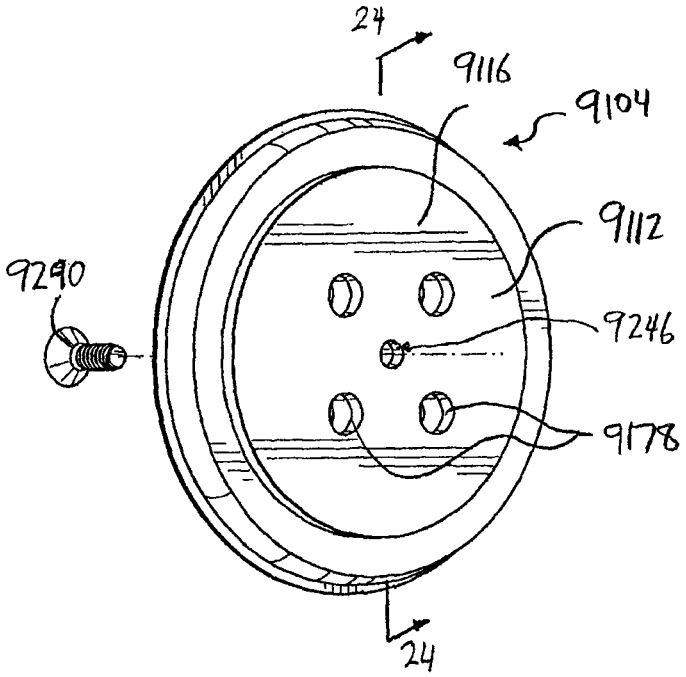
FIG. 23 is a rear perspective view of a back-up apparatus.
Figure 24:
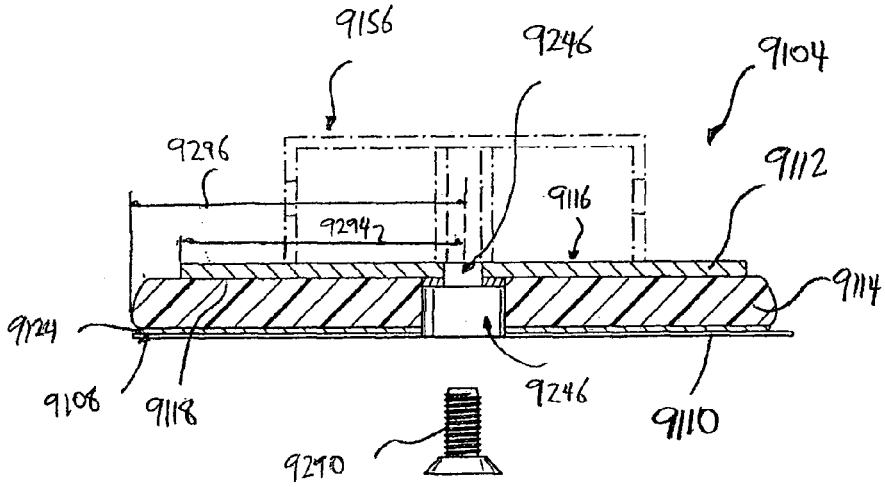
FIG. 24 is a section view taken along line 24-24 in FIG. 23.

Referring to FIGS. 23 and 24, an example of a back-up apparatus 9104 includes a generally planar back-up plate 9112, a back-up pad 9114 and an interface layer 9124. The back-up apparatus may be generally similar to the back-up apparatus 1104, 2104, etc. and like features are identified using like reference numerals, starting at 9104.

The planar back-up plate 9112 has a planar pad attachment face 9118 and a parallel, opposed planar rear face 9116. The planar back-up plate 9112 is adapted to be mounted to a driving apparatus. For example, planar back-up plate 9112 may also include a central plate bore or aperture 9244 sized to removably receive a mounting fastener 9290, for connecting the back-up apparatus 9104 to a suitable driving apparatus.

The back-up pad 9114 can be any suitable back-up pad, including, for example, any of the back-up pads described herein. In the illustrated example, the back-up pad 9114 has a first pad face 9120, fixedly fastened to the pad attachment face 9118, and second pad face 9122 coupled to the interface layer 9124.

The interface layer 9124 includes an abrasive mounting face 9108 for supporting an abrasive sheet 9110. The back-up pad 9114 and the interface layer 9124 include a central pad aperture 9246 and central interface aperture 9288, respectively, registered with the central plate aperture 9246. The central pad aperture 9246 and interface aperture 9288 co-operate to extend from the pad attachment face 9118 to the abrasive mounting face 9108. The central pad aperture 9246 and interface aperture 9288 are sized to removably receive the mounting fastener 9290. In this configuration, the mounting fastener 9290 (for example a mounting bolt) is not permanently coupled to, or molded into, the back-up plate 9112. Accordingly, mounting fastener 9290 can be separated from the back-up plate 9112, and the same mounting fastener 9290 can be re-used to attach multiple back-up plates 9112.

Preferably, the planar material used to form the back-up plate is generally rigid, with sufficient strength to withstand the expecting operating conditions of the sanding apparatus, including, for example polycarbonate, plastics, wood, metal and composite materials, preferably thermoplastic polymers and more preferably polycarbonate. The plate may have a thickness from about 2 mm to about 20 mm and preferably between about 5 mm to about 15 mm. In the illustrated example, the planar plate material has a tensile strength of between about 40 MPa to about 80 MPa or more and a Young's modulus of between about 1.8 GPa and about 2.5 GPa or higher. Alternatively, the plate material can have a tensile strength that is lower than 40 MPa or higher than 80 MPa, and can have a Young's modulus that is lower than about 1.8 GPa or higher than about 2.5 GPa.

In addition to including a central mounting aperture 9246, a plurality of plate suction apertures 9178 can be formed in the planar back-up plate 9112. Optionally, the back-up plate 9112 can be provided with plate suction apertures, even if it is not intended to be used in a sanding apparatus that includes a suction system.

For example, optionally, all of the back-up plates manufactured can include plate suction apertures. In this configuration, the presence of plate suction apertures will not materially affect the performance of a non-suction back-up pad (the back-up pad material will simply cover the apertures 9178), and being equipped with plate suction apertures will enable the planar back-up plates to be used in combination with the suction systems described herein. Manufacturing back-up plates in this manner may allow a single configuration of back-up plate to be used with both suction and non-suction sanding apparatuses. This may help reduce the cost of producing the back-up plates, as the configuration of the back-up plates need not be changed based on the type of back-up pad used.

Figure 25:
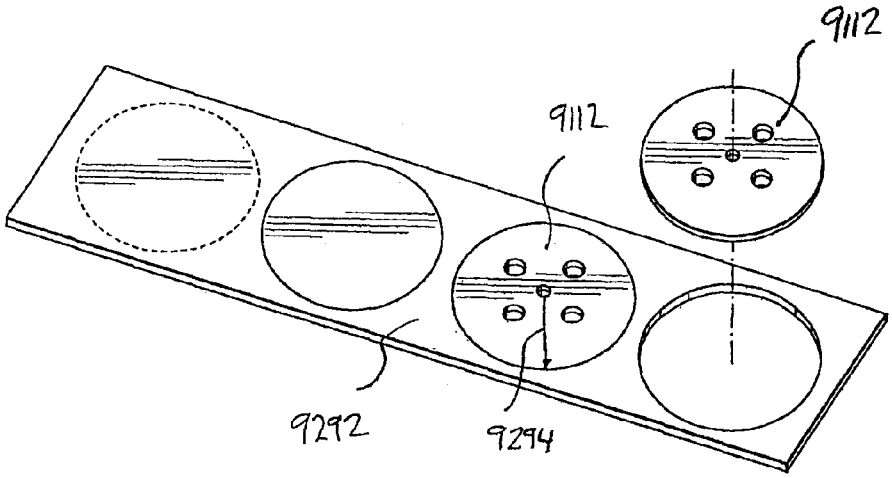
FIG. 25 is a perspective view of a sheet of back-up plate material.

Referring to FIG. 25, instead of molding, the planar back-up plates 9112 can be formed by forming the back-up plates 9112 from larger, planar sheets of material 9292. As used herein, forming is intended include other analogous separating operations, including, for example, cutting, milling, drilling, stamping, routing, etc.

The method of manufacturing the planar back-up plate 9112 can include the steps of providing a planar sheet of plate material 9292 and forming a back-up plate 9112 from the sheet of plate material 9292. The method can also include the steps of forming a central mounting aperture 9246 in the back-up plate 9112 to accommodate a mounting fastener 9290. The forming operation may comprise cutting, stamping and the like.

Optionally, the method includes cutting the back-up plate 9112 into a circular disc shape having a plate radius 9294. Circular back-up plates are suitable for use in combination with the sanding apparatuses described herein. In other examples, the back-up plates need not be circular.

Preferably, the plate radius 9294 is selected so that it is smaller than a pad radius 9296 of a back-up pad 9114 that is to be coupled to the back-up plate 9112. Optionally, the plate radius 9294 can be between about 50 and about 100% of the back-up pad radius 9296. Configuring the back-up plate 9112 to be smaller than the back-up pad 9114 may help facilitate axial bending and flexing of the peripheral portion of the back-up pad 9114. The difference between the plate radius 9294 and the pad radius 9296 may be selected based on the desired amount of flexing of the back-up pad 9114.

Optionally, the steps of cutting the planar back-up plate 9112, forming the central mounting aperture 9246 and forming the plurality of plate suction apertures 9178 can be performed substantially simultaneously. This may help increase production speed. Alternatively, these steps can be performed sequentially.

To assembly the back-up apparatus 9104, the back-up pad 9114 can be glued to the planar back-up plate 9112.

Surface Treating Apparatus with Suction System that is Compatible with Fibre Discs In accordance with another aspect of this specification, which may be used by itself or with any one or more other aspects of this specification, a surface treating apparatus that includes a suction system can be configured to be compatible for use in grinding operations and for use with fibre discs and other relatively aggressive abrasive media. The surface treating apparatus can include a back-up plate that is configured for use with fibre discs, and the like, and need not include a compliant, flexible back-up pad. To facilitate suction, for example in a manner analogous to the apparatuses described above, the back-up plate and fibre disc can include suction apertures and suction holes, respectively. The suction apertures in the back-up plate can be through holes, or can be configured in any other suitable configuration, including, for example, having suction channels, conduits and plenums as described herein.

Conventional fibre disc sanding apparatuses do not include back-up apparatuses of the nature described herein. The stiffness of the fibre disc abrasive sheets can be sufficient to be used in grinding operations without the need for an external back-up apparatus. Also, in conventional grinding applications, the fibre disc abrasive is not intended to follow the contours of a surface being grinded, and the flexibility of the back-up pads described herein may be unnecessary.

Conventional fibre disc sanding apparatuses also do not include suction systems of the nature describe herein. Conventional fibre discs do not include suction holes, and the sanding apparatuses do not include suction housings, etc. Conventional fibre disc sanding apparatuses are operated without a back-up apparatus suitable for connection with a suction system. Further, the coarse nature of the abrasive material used on conventional fibre discs, and the nature of the surfaces being grinded, makes fibre discs less likely than conventional, fine grain sand paper to become clogged with sanding debris.

Forming suction holes in conventional fibre discs can result in accelerated wear on the forming tools (such as a press or die) due to the nature of the strong abrasive materials coating the fibre disc.

The inventor has discovered that fibre discs can be used in combination with a back-up plate. The inventor has also discovered that fibre discs can be provided with suction holes, and can be used in combination with a suction system. Providing a fibre disc mounted to a back-up plate, and/or equipped with suction holes may help improve the performance of the fibre disc.

Figure 26:
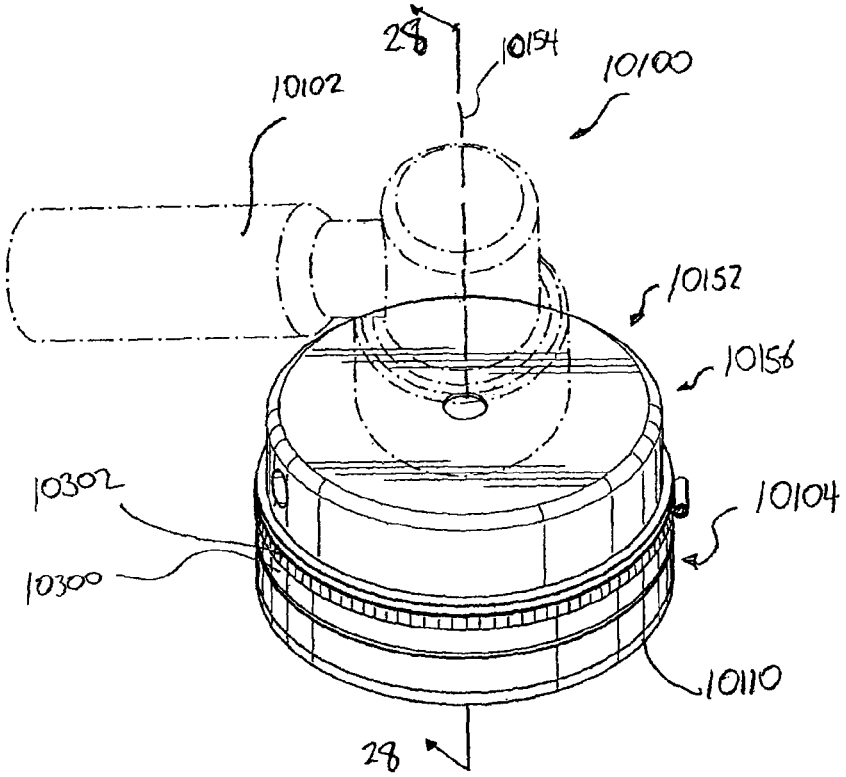
FIG. 26 is a perspective view of another example of a sanding apparatus, with a driving apparatus shown in phantom.
Figure 27:
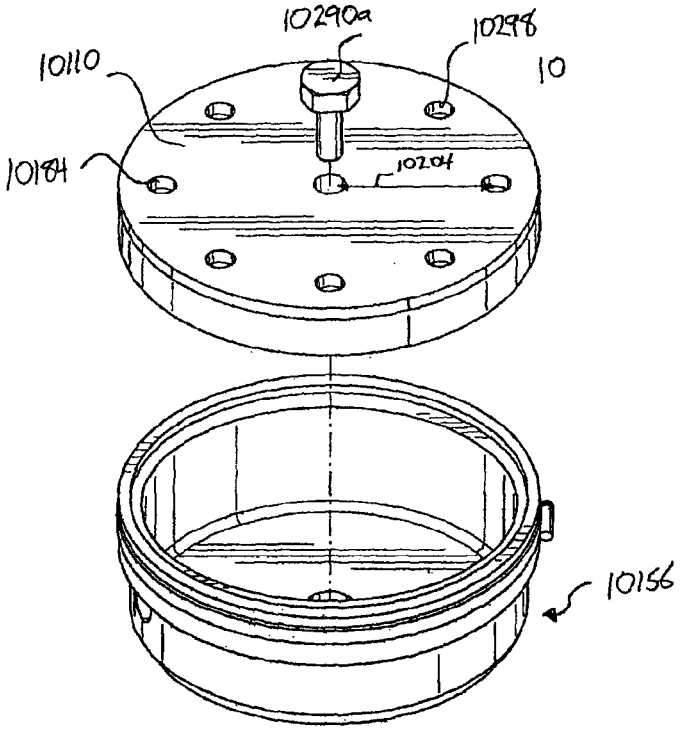
FIG. 27 is a partially exploded view of the back-up apparatus and suction apparatus of FIG. 26.

Referring to FIG. 26, a sanding apparatus 10100 includes a driving apparatus 10102, a back-up apparatus 10104, a suction system 10152 and an abrasive sheet 10110. The driving apparatus 10102 can be any suitable driving apparatus, including a rotatory driving apparatus (such as an air grinder and an electric grinder). The back-up apparatus 10104 is rotatably coupled to the driving apparatus 10102, and is rotatable about a central axis 10154. The sanding apparatus 10100 may be generally similar to the sanding apparatuses 100, 1100, 2100, etc, and like elements are identified using like reference numerals, starting at 10100.

Figure 28:
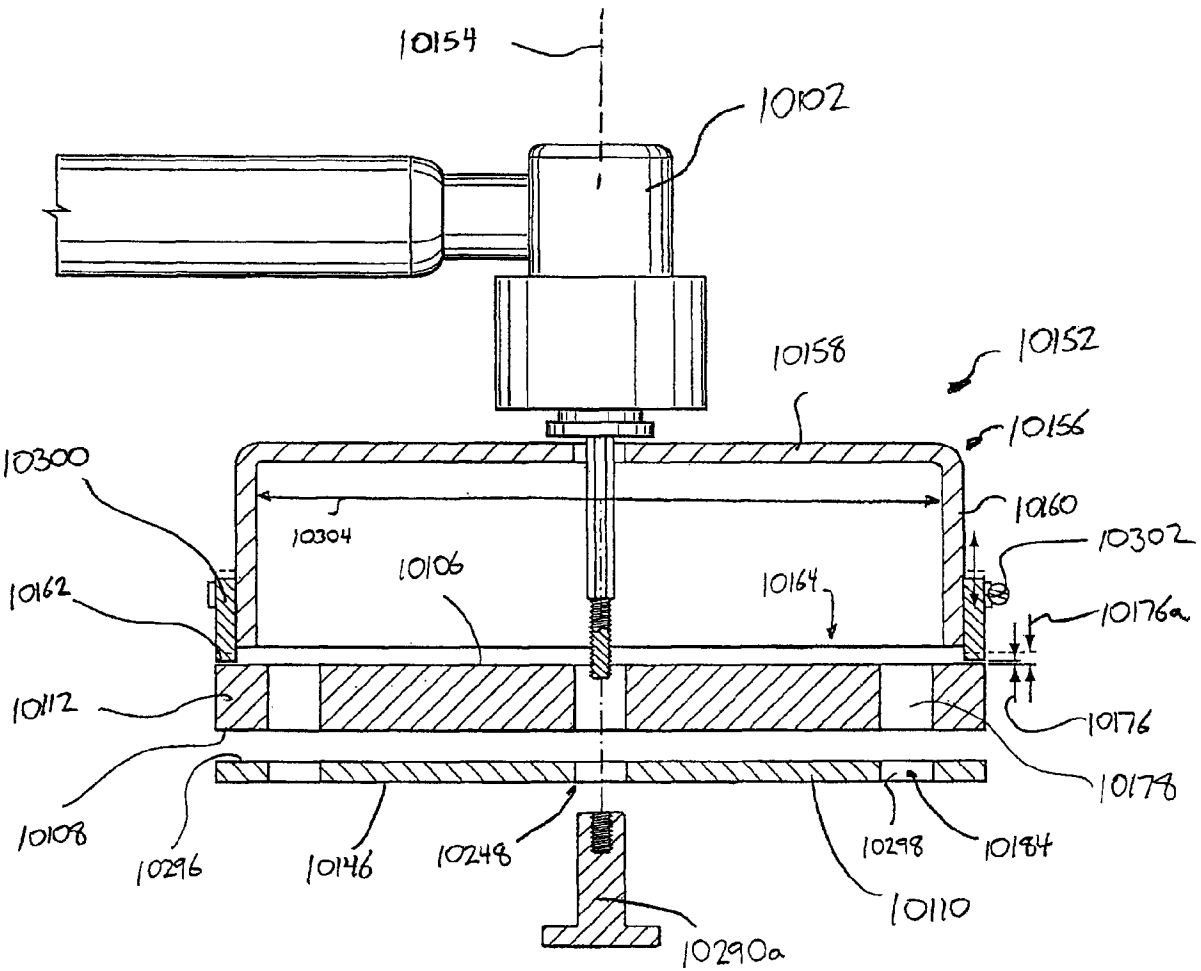
FIG. 28 is a section view taken along line 28-28 in FIG. 26.

Referring also to FIG. 28, in this example, the back-up apparatus 10104 includes a rigid back-up plate 10112 that is configured to be directly connected to the fibre disc abrasive sheet 10110. In this configuration, the back-up plate 10112 includes the abrasive mounting face 10108 and the opposed rear face 10106. This back-up apparatus 10104 does not include a back-up pad. Alternatively, some type of compatible back-up pad, or other intermediate layer could be included between the back-up plate and the abrasive sheet.

The back-up plate 10112 includes a central mounting aperture 10246 that is configured to accept a mounting fastener 10290, for example central mounting nut **10290*a*. The fibre disc abrasive sheet 10110 includes a corresponding central aperture 10248 that is registered with the mounting aperture 10246. The mounting nut 10290*a* extends through the apertures 10246, 10248 and secures the fibre disc abrasive sheet 10110 to the back-up plate 10112. The mounting nut 10290*a*** can be any suitable fastener, including a conventional mounting nut that is conventionally used to attached fibre discs to conventional driving apparatuses.

Optionally, the abrasive mounting face 10108 can include an adhesive layer to help inhibit relative rotation between the fibre disc 10110 and the back-up plate 10112 The adhesive layer can be any suitable type of adhesive, including the two-layer, releasable adhesive described above.

The back-up plate 10112 can include plurality of plate suction apertures 10178 extending through the back-up plate. In the illustrated example, the plate suction apertures 10178 are arranged along a constant circumference, at a radial distance 10204 from the central axis 10154, toward the periphery of the back-up plate 10112. Alternatively, the apertures 10178 can be arranged in other suitable patterns, and need not be on a constant circumference.

One example of an abrasive fibre disc 10110 that is suitable for use with the back-up plate includes an abrasive surface coated 10146 with abrasive material and an opposed mounting surface 10296 adjacent the pad attachment face 10108 of the back-up plate 10112. The fibre disc 10110 also includes a plurality of disc suction holes 10184 registrable with corresponding ones of the plurality of plate suction apertures 10178. In this configuration, the plurality of suction holes 10184 are spaced an equal radial distance from the central axis of rotation 10154.

A method of manufacturing abrasive fibre disc 10110 can include the steps of i) providing a sheet of base material, ii) cutting the base material into a disc shape, iii) forming a central mounting aperture in the centre of the disc, iv) forming a plurality of discrete suction holes in the disc, and v) after forming the central mounting aperture and the plurality of suction apertures, coating at least one side of the disc with abrasive material.

Optionally, the mounting aperture 102048 and the suction holes 10184 can be formed generally simultaneously.

When manufactured using this method, the sidewalls 10298 of the plurality of suction holes 10184 can be coated with the abrasive material.

The sanding apparatus 10100 can also include a suction apparatus 10152 in fluid communication with the plate suction apertures 10178 extracting sanding/grinding waste through the fiber disc 10110 and back-up apparatus 10104. The suction apparatus 10152 can be of any suitable configuration, and optionally can include a suction housing 10156 having a suction housing inlet 10164 opposite the rear face 10106 of back-up plate 10112. The suction inlet 10164 is surrounded by a suction housing sidewall 10160. In this configuration, the plurality of plate suction apertures 10178 are radially inboard from the suction housing sidewall 10160.

The suction apparatus 10152 has a first edge 10162 that is adjacent but spaced apart from the rear face 10106 of the back-up plate 10112 by a suction spacing distance 10176. As described in detail above, the suction spacing distance 10176 can be set to allow the back-up plate 10112 to rotate relative to the suction housing sidewall 10160 while constricting airflow through the gap between the edge 10162 and the back-up plate 10112 to help preserve the suction.

Optionally, the suction spacing distance 10176 can be adjustable. Adjusting the suction space distance 10176 can adjust the size of the gap between the edge 10162 of the suction housing 10156 and the back-up plate 10112. Changing the size of the gap can vary the amount of air that is drawn in through the gap, which may vary the amount of suction at the abrasive mounting face 10108. For example, increasing the size of the gap, to suction spacing distance 10176*a* shown in phantom (FIG. 30), may allow more air to be draw into the suction housing 10156, which may decrease the suction at the abrasive mounting face 10108. Adjusting the size of the gap in this manner may allow a user to adjust the amount of suction applied to the surface being grinded.

If the suction is too strong, the fibre disc 10110 may become non-rotatably stuck to the surface. This may inhibit grinding of the surface. This may also cause damage to the driving apparatus. Alternatively, if the suction is too weak, grinding debris may not be effectively drawn through the suction holes 10184 and plate suction apertures 10178 for disposal. It may be desirable for a use to be able to vary the level of suction while the grinding apparatus wherein the first edge 10162 is moveable relative to the back-up plate in a direction parallel to the central axis 10154 of rotation to alter the suction spacing distance 10176 to adjust the suction strength.

In the present example, the suction apparatus 10152 includes a collar 10300 that is movably coupled to the suction housing 10156. The collar 10300 surrounds the suction housing sidewall 10160 and is translatable in the axial direction (i.e. toward and away from the back-up plate). Moving the collar 10300 translates the first edge 10162 relative to the back-up plate 10112. In the illustrated example, the collar 10300 is an annular ring of sheet metal that fits around, and can move axially relative to the suction housing side wall 10160. Alternatively, the suction apparatus need not include a separate movable collar. Instead, the suction housing 10156 can be movably connected to the driving apparatus 10102 so that the entire suction housing 10156 can be moved to vary the suction spacing distance. A suitable securing apparatus, for example a clamp or a securable actuator can be used to hold the suction housing 10156 in a desired position relative to the back-up plate.

A securing apparatus can be used to secure the ring 10300 to the suction housing 10156, to inhibit relative axial movement therebetween. In the illustrated example, the securing apparatus comprises an annular clamp 10302 configured to clamp the collar 10300 against the housing sidewall 10160. The position of the collar 10300 can then be adjusted by loosening the clamp 10302, sliding the collar 10300 into a desired position and then tightening the clamp 10302 to secure the collar 10300 in place. Alternatively, other securing apparatuses can be used, including, for example, a threaded connection, a radial set screw, a movable actuator and an interference fit.

Optionally, the collar 10300 can be manually positioned by a user. Alternatively, the collar 10300 can be automatically movable, for example using a suitable collar actuator (not illustrated), to maintain a desired level of suction at the abrasive mounting face 10108. In such an example, the sanding apparatus 10100 can also include a variety of sensors, transducers and controllers.

Optionally, the collar 10300 is movable while the back-up plate 10112 is rotating.

The size of the suction housing 10156, for example the diameter 10304 of the suction housing sidewall 10160 and the collar 10300, can be selected based on the size of the fibre disc 10110, and the location of the plate suction apertures 10178. The suction housing 10156 is selected so that the plate suction apertures 10178 are located radially inboard of the collar 10300.

Configuration of an Auxiliary Member

In accordance with another aspect of this specification, which may be used by itself or with any one or more other aspects of this specification, an auxiliary member can be positioned between the back-up pad and the abrasive sheet. The auxiliary member can be permanently or removeably attached to the back-up apparatus. Providing an auxiliary member can allow a user to modify the properties of the back-up apparatus. One example of an auxiliary member is a sponge member that is generally softer and more compliant than the back-up pad to which it is mounted.

Figure 29:
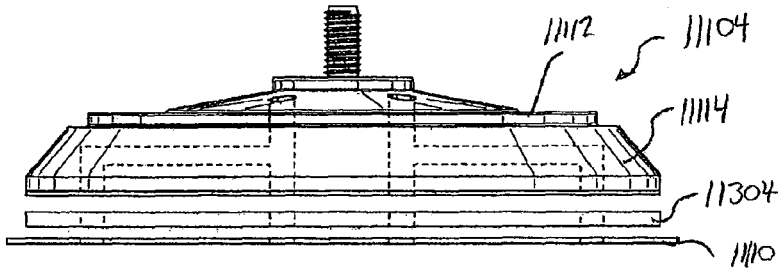
FIG. 29 is partially exploded side view of another example of a back-up apparatus.

Referring to FIG. 29, optionally, a separate sponge member 11304 can be used in combination with the back-up pads described herein. The sponge member 1104 can be positioned between the back-up pad 11114 and the abrasive sheet 11110. The sponge member 1104 can be relatively softer and more pliable than the back-up pad 11114 material. Providing a sponge member 11304 may help facilitate gentler and/or more delicate sanding operations, such as buffing and polishing, when used with a corresponding, appropriate abrasive material. The sponge member can be made from any suitable material including, for example, sponge foams and sponge rubbers, and preferably is urethane foam.

The sponge member 11304 can be configured to include some of all of the features of, or to be compatible with the back-up pads described above, including, for example, an adhesive interface layer 11124, and a variety of suction apertures, channels and internal conduits (examples of which are shown in phantom). The sponge member 11304 can also be configured so that it can be engaged by a mounting tool, which may help align and mount the sponge member on a suitable back-up pad.

Optionally, the sponge member 11304 can be inserted between the back-up pad 11114 and a relatively rough abrasive sheet 11110. The outer face of the sponge member 11304 can also be coated with a relatively fine abrasive material. In this configuration a surface treating apparatus can be quickly reconfigured from using a relative rough abrasive material to using a relatively fine abrasive material by removing the abrasive sheet 11110 to expose the outer surface of the sponge member 11304.

A variety of examples of sanding apparatuses are described herein. A given sanding apparatus can include some, or all, or any combination or sub-combination of the features described herein. For example, a sanding apparatus can include an adhesive interface layer and a plurality of suction holes, and/or open suction channels and/or suction conduits. Similarly, a sanding apparatus can include a back-up pad formed from a live rubber material, be configured to use a central safety fastener and include a mechanical (hook and loop) interface layer. Any of the examples herein can be configured to include the adhesive interface layer and/or the safety fastener.

Embodiments of sanding apparatuses may or may not include suction systems, depending on the application. If a suction system is desired, the sanding apparatus can be configured to include a plurality of suction apertures, channels and conduits as desired, and the abrasive sheets can be configured to include a corresponding plurality of suction holes.

No example is intended to be limiting or exclusive of any other examples described herein, and a sanding apparatus can be equipped with any compatible combination of features.

What has been described above has been intended to be illustrative of the invention and non-limiting and it will be understood by persons skilled in the art that other variants and modifications may be made without departing from the scope of the invention as defined in the claims appended hereto.

The invention claimed is:

1. A surface treating apparatus comprising:

a. a back-up apparatus connectable to a driving apparatus and rotatable about a central axis, the back-up apparatus comprising a back-up plate having an abrasive mounting face and an opposed rear face, a plate mounting aperture formed in the back-up plate and aligned with the central axis and a plurality of plate suction apertures extending through the back-up plate, the plurality of plate suction apertures being spaced apart from each other around the periphery of the back-up plate;

b. an abrasive fibre disc, the fibre disc having an abrasive surface coated with abrasive material and an opposed mounting surface adjacent the abrasive mounting face of the back-up plate, the fibre disc comprising a central mounting aperture registered with the plate mounting aperture, and a plurality of disc suction apertures spaced apart from each other about the periphery of the fibre disc and registered with corresponding ones of the plurality of plate suction apertures;

c. a mounting fastener for attaching the fibre disc to the surface treating apparatus, the mounting fastener configured to extend through the plate mounting aperture and the central mounting aperture and to engage at least one of the back-up apparatus and the driving apparatus;

d. a suction apparatus comprising a suction housing, the suction housing comprising a suction housing inlet opposite the rear face of back-up plate and surrounded by a suction housing sidewall, the suction housing sidewall being radially outboard of the plurality of disc suction apertures and the suction housing inlet covering substantially all of the rear face of the back-up plate and being in fluid communication with the plurality of plate suction apertures for extracting sanding waste through the fiber disc and back-up apparatus.

2. The surface treating apparatus of claim 1, wherein the plurality of disc suction apertures are spaced an equal radial distance from the central axis of rotation.

3. The surface treating apparatus of claim 1, wherein the plurality of plate suction apertures are radially inboard from the suction housing sidewall.

4. The surface treating apparatus of claim 1, wherein the suction apparatus comprises a first edge that is spaced apart from the rear face of the back-up plate by a suction spacing distance, and wherein the first edge is moveable relative to the back-up plate in a direction parallel to the central axis of rotation whereby the suction spacing distance can be altered to adjust the suction strength.

5. The surface treating apparatus of claim 4, wherein the suction apparatus comprises a collar coupled to the suction housing and translatable relative to the suction housing, the collar comprising the first edge.

6. The surface treating apparatus of claim 5, further comprising a securing apparatus configured to secure the collar to the suction housing thereby inhibiting relative movement therebetween.

7. The surface treating apparatus of claim 6, wherein the securing apparatus comprises a clamp.

8. The surface treating apparatus of claim 4, wherein the suction housing is longitudinally movably coupled to the driving apparatus, the suction housing comprising the first edge.

9. The surface treating apparatus of claims 4, wherein the first edge is moveable while the back-up plate is rotating.

10. The surface treating apparatus of claim 4, wherein the disc suction apertures comprising aperture sidewalls that are at least partially coated with the abrasive material.

11. The surface treating apparatus of claim 4, wherein the back-up plate is rigid.

12. The surface cleaning apparatus of claim 1, wherein the mounting fastener threadingly engages both the plate mounting aperture and a portion of the driving apparatus.

13. The surface cleaning apparatus of claim 1, wherein the plate mounting aperture is a through-hole having a threaded inner surface and the mounting fastener threadingly engaging the inner surface of the plate mounting aperture and extending axially beyond the rear face of the back-up apparatus.

14. The surface cleaning apparatus of claim 12, wherein the plate mounting aperture is co-axial with the central axis.

15. The surface cleaning apparatus of claim 1, wherein the mounting fastener includes an attachment portion passing through the central mounting aperture and extending beyond the rear face of the back-up apparatus and configured to threadingly engage a portion of the driving apparatus thereby directly fastening the abrasive fibre disc to the driving apparatus.

16. The surface cleaning apparatus of claim 1 wherein the rear face of the back-up plate is generally planar.

17. The surface cleaning apparatus of claim 1, wherein the mounting surface of the abrasive fibre disc is directly connected to the abrasive mounting face of the back-up plate.

* * * * *